US008109602B2

(12) United States Patent
Nomura et al.

(10) Patent No.: US 8,109,602 B2
(45) Date of Patent: Feb. 7, 2012

(54) IMAGE FORMING APPARATUS AND IMAGE FORMING METHOD

(75) Inventors: Seiya Nomura, Kyoto (JP); Yoshitomo Wada, Kyoto (JP); Katsuki Fukuyama, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 341 days.

(21) Appl. No.: 12/411,789

(22) Filed: Mar. 26, 2009

(65) Prior Publication Data

US 2009/0244178 A1 Oct. 1, 2009

(30) Foreign Application Priority Data

Mar. 31, 2008 (JP) ..... 2008-092337

(51) Int. Cl.

| | |
|---|---|
| ***B41J 29/38*** | (2006.01) |
| ***B41J 29/393*** | (2006.01) |
| ***B41J 23/00*** | (2006.01) |
| ***B41J 2/15*** | (2006.01) |

(52) U.S. Cl. ..... 347/37; 347/14; 347/16; 347/19; 347/41

(58) Field of Classification Search ..... 347/19, 347/14, 16, 37, 41

See application file for complete search history.

(56) References Cited

U.S. PATENT DOCUMENTS 6,290,320 B1 * 9/2001 Beauchamp et al. ..... 347/19

FOREIGN PATENT DOCUMENTS

| | | |
|---|---|---|
| EP | 1 384 585 A | 1/2004 |
| JP | 11-245388 | 9/1999 |

OTHER PUBLICATIONS

European Search Report issued in European Patent Application No. EP 09 00 4369.6 dated Dec. 10, 2009.

* cited by examiner

*Primary Examiner* — Jason Uhlenhake

(74) *Attorney, Agent, or Firm* — McDermott Will & Emery LLP

(57) ABSTRACT

An image forming apparatus for forming an appropriate test pattern is provided. A control section 41 includes: an image combination section 412 for combining image information corresponding to a subject image P1 of a first resolution, with second pattern information which corresponds to a test pattern P2 of a second resolution different from the first resolution, and which represents image information of the first resolution, so as to generate combined image information as one piece of image information; and an operation instruction section 413 for instructing a recording head 1, a head driving section 2, and a medium driving section 3 to form, on a recording medium, the combined image information corresponding to one piece of image information.

16 Claims, 14 Drawing Sheets

FIG. 12A
| RESOLUTION (dpi) | | IMAGE DATA OF TEST PATTERN | FIG. NO. |
|---|---|---|---|
| PRIMARY SCANNING DIRECTION | SECONDARY SCANNING DIRECTION | | |
| 300 | 150 | P2 | FIG. 11A |
| 300 | 300 | P21B | FIG. 12B |
| 600 | 150 | P21C | FIG. 12C |
| 600 | 300 | P21A, P22A | FIG. 11B, FIG. 11C |
FIG. 12B
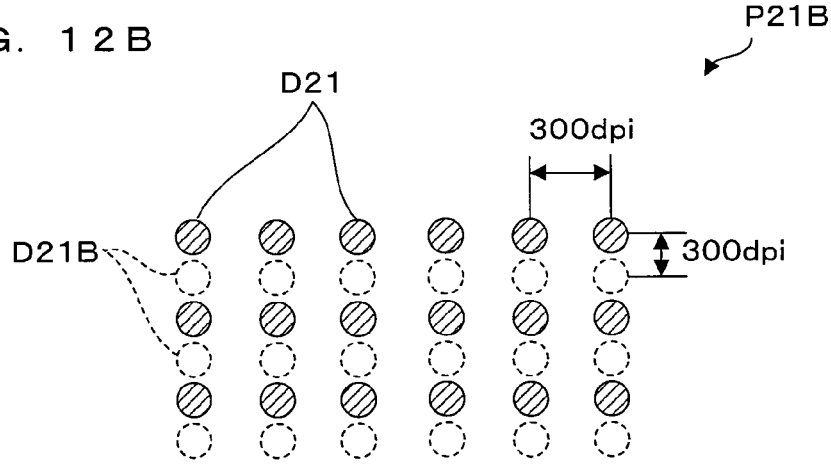
FIG. 12C
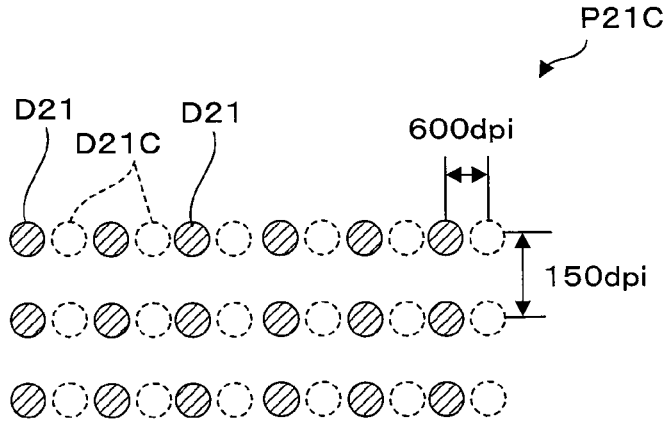

IMAGE FORMING APPARATUS AND IMAGE FORMING METHOD

BACKGROUND OF THE INVENTION

1. Field of the Invention

The present invention relates to an image forming apparatus and an image forming method for forming an image on a recording medium. More specifically, the present invention relates to an image forming apparatus and an image forming method each of which comprises: a recording head having aligned in a secondary scanning direction a plurality of dot forming sections each of which is a component for forming a dot on a recording medium; primary scanning portion for moving the recording head relative to the recording medium in a primary scanning direction intersecting the secondary scanning direction; and secondary scanning portion for moving the recording head relative to the recording medium in the secondary scanning direction, and each of which forms, on the recording medium, a subject image which is a predetermined image, by moving the recording head relative to the recording medium by means of the primary scanning portion and the secondary scanning portion.

2. Description of the Background Art

Conventionally, an image forming apparatus such as an ink-jet recording apparatus needs to have an enhanced resolution so as to improve a quality of an image to be formed, and various apparatuses and methods for realizing the enhancement of the resolution are suggested. For example, the ink-jet recording apparatus has limitations in enhancing the resolution by reducing a nozzle pitch (=a distance between two adjacent nozzles) of a recording head, and therefore it is suggested that recording is performed by using an interlace mode in which a record dot pitch smaller than the nozzle pitch is used.

Specifically, disclosed is an interlace-mode ink-jet recording apparatus in which primary scanning is performed multiple times in each of the nozzle pitches aligned in a recording head in a secondary scanning direction so as to record an image by using a record dot pitch (=a distance between two adjacent dots on a recording medium) which is smaller than a distance between two adjacent recording nozzles (see Japanese Laid-Open Patent Publication No. 11-245388).

On the other hand, in an ink-jet recording apparatus, some nozzles aligned in a recording head may be clogged with ink (so-called "nozzle clogging" may occur), and, in this case, an image having a high quality cannot be formed. Therefore, conventionally, a test pattern used for allowing visual determination as to whether or not a nozzle is clogged is formed on a recording medium such as recording paper on which an image is formed.

However, a conventional image forming apparatus such as the ink-jet recording apparatus disclosed in Japanese Laid-Open Patent Publication No. 11-245388 does not allow the visual determination of the nozzle clogging when an image is formed in the interlace mode because a distance between two adjacent dots is too narrow in the test pattern.

SUMMARY OF THE INVENTION

The present invention is made to solve the problems described above, and an object of the present invention is to provide an image forming apparatus and an image forming method for enabling formation of an appropriate test pattern.

The present invention has the following features to attain the object mentioned above. A first aspect of the present invention is directed to an image forming apparatus comprising: a recording head (1) having aligned in a secondary scanning direction a plurality of dot forming sections each of which is a component for forming a dot on a recording medium; primary scanning portion (2) for moving the recording head (1) relative to the recording medium in a primary scanning direction intersecting the secondary scanning direction; and secondary scanning portion (3) for moving the recording head relative to the recording medium in the secondary scanning direction, and the image forming apparatus moves the recording head (1) relative to the recording medium by means of the primary scanning portion (2) and the secondary scanning portion (3) so as to form, on the recording medium, a subject image which is a predetermined image, and the image forming apparatus comprises first instruction portion (413) and second instruction portion (413). The first instruction portion (413) instructs the recording head (1), the primary scanning portion (2), and the secondary scanning portion (3) to form the subject image of a first resolution which is previously set. Further, the second instruction portion (413) instructs the recording head (1), the primary scanning portion (2), and the secondary scanning portion (3) to form, in an area other than an area in which the subject image on the recording medium is formed, a test pattern of a second resolution which is previously set and is different from the first resolution.

In a second aspect based on the first aspect, a resolution, for the primary scanning direction, included in the second resolution is lower than a resolution, for the primary scanning direction, included in the first resolution, or a resolution, for the secondary scanning direction, included in the second resolution is lower than a resolution, for the secondary scanning direction, included in the first resolution, or a resolution, for the primary scanning direction, included in the second resolution and a resolution, for the secondary scanning direction, included in the second resolution are lower than a resolution, for the primary scanning direction, included in the first resolution, and a resolution, for the secondary scanning direction, included in the first resolution, respectively.

In a third aspect based on the second aspect, the first resolution enables an image to be formed in an interlace mode, and the second resolution enables an image to be formed in a non-interlace mode other than the interlace mode.

In a fourth aspect based on the first aspect, first pattern storage portion and pattern generation portion are provided. The first pattern storage portion previously stores first pattern information representing image information of the second resolution corresponding to the test pattern of the second resolution. Further, the pattern generation portion reads the first pattern information from the first pattern storage portion, and generates, based on the first pattern information having been read, second pattern information representing image information of the first resolution corresponding to the test pattern of the second resolution. Furthermore, the second instruction portion operates so as to form the test pattern of the second resolution based on the second pattern information having been generated by the pattern generation portion.

In a fifth aspect based on the fourth aspect, when the first resolution is higher than the second resolution, the pattern generation portion adds, to the first pattern information, image information representing a pixel at which a dot is not formed, and an amount of the image information to be added corresponds to a number of pixels obtained by subtracting a number of pixels corresponding to the second resolution from a number of pixels corresponding to the first resolution, so that the second pattern information is generated.

In a sixth aspect based on the first aspect, second pattern storage portion (414) is provided. The second pattern storage portion (414) previously stores second pattern information representing image information of the first resolution corresponding to the test pattern of the second resolution, the second pattern information being generated based on first pattern information representing image information of the second resolution corresponding to the test pattern of the second resolution. Further, the second instruction portion (413) reads the second pattern information stored in the second pattern storage portion, and forms the test pattern of the second resolution based on the second pattern information having been read.

In a seventh aspect based on the sixth aspect, resolution setting portion (411) is provided. The resolution setting portion (411) receives an operation input from an outside, and sets, as the first resolution, one of a plurality of resolutions which are previously set, based on the operation input having been received. Further, the second pattern storage portion (414) previously stores a plurality of pieces of image information so as to be associated with the plurality of resolutions, respectively, the plurality of pieces of image information each corresponding to the test pattern of the second resolution and being generated based on the first pattern information. Furthermore, the second instruction portion (413) reads, from the second pattern storage portion (414), one of the plurality of pieces of image information associated with the one of the plurality of resolutions having been set as the first resolution, and forms the test pattern of the second resolution based on the one of the plurality of pieces of image information having been read.

In an eighth aspect based on the first aspect, second pattern storage portion (414) and image combination portion (412) are provided. The second pattern storage portion (414) previously stores second pattern information representing image information of the first resolution corresponding to the test pattern of the second resolution, the second pattern information being generated based on first pattern information representing image information of the second resolution corresponding to the test pattern of the second resolution. Further, the image combination portion (412) combines the second pattern information with image information corresponding to the subject image of the first resolution so as to generate combined image information as one piece of image information. Furthermore, the first instruction portion (413) and the second instruction portion (413) form the subject image of the first resolution and the test pattern of the second resolution, respectively, based on the combined image information generated by the image combination portion (412).

In a ninth aspect based on the first aspect, combined image storage portion is provided. The combined image storage portion previously stores combined image information corresponding to one piece of image information generated by combining second pattern information with image information corresponding to the subject image of the first resolution, the second pattern information representing image information of the first resolution corresponding to the test pattern of the second resolution, the second pattern information being generated based on first pattern information representing image information of the second resolution corresponding to the test pattern of the second resolution. Further, the first instruction portion and the second instruction portion read the combined image information stored in the combined image storage portion, and form, based on the combined image information having been read, the subject image of the first resolution and the test pattern of the second resolution, respectively.

In a tenth aspect based on the first aspect, the test pattern includes a test pattern generated by a specific dot forming section which is previously set and is at least one of the plurality of dot forming sections aligned in the recording head (1) in the secondary scanning direction.

In an eleventh aspect based on the tenth aspect, the specific dot forming section is at least one of dot forming sections positioned on both ends of the recording head (1), among the plurality of dot forming sections aligned in the recording head (1) in the secondary scanning direction.

In a twelfth aspect based on the tenth aspect, the test pattern is an almost rectangular pattern having sides extending in the primary scanning direction and sides extending in the secondary scanning direction, and the test pattern generated by the specific dot forming section projects from one of the sides extending in the secondary scanning direction, the one of the sides corresponding to a part of a rectangle forming an outer edge of the test pattern.

In a thirteenth aspect based on the first aspect, the second instruction portion (413) forms the test pattern at a position distanced by a predetermined distance in the primary scanning direction from the area in which the subject image on the recording medium is formed.

A fourteenth aspect of the present invention is directed to an image forming method performed by an image forming apparatus (100) which comprises: a recording head (1) having aligned in a secondary scanning direction a plurality of dot forming sections each of which is a component for forming a dot on a recording medium; primary scanning portion (2) for moving the recording head (1) relative to the recording medium in a primary scanning direction intersecting the secondary scanning direction; and secondary scanning portion (3) for moving the recording head (1) relative to the recording medium in the secondary scanning direction, and which moves the recording head (1) relative to the recording medium by means of the primary scanning portion (2) and the secondary scanning portion (3) so as to form, on the recording medium, a subject image which is a predetermined image, and, in the image forming method, a first instruction step (S109) and a second instruction step (S109) are performed. The first instruction step (S109) instructs the recording head (1), the primary scanning portion (2), and the secondary scanning portion (3) to form the subject image of a first resolution which is previously set. Further, the second instruction step (S109) instructs the recording head (1), the primary scanning portion (2), and the secondary scanning portion (3) to form, in an area other than an area in which the subject image on the recording medium is formed, a test pattern of a second resolution which is previously set and is different from the first resolution.

According to the first aspect, the recording head (1), the primary scanning portion (2), and the secondary scanning portion (3) are instructed to form a subject image of a first resolution which is previously set. Further, the recording head (1), the primary scanning portion (2), and the secondary scanning portion (3) are instructed to form, in an area other than an area in which the subject image on the recording medium is formed, a test pattern of a second resolution which is previously set and is different from the first resolution. Therefore, it is possible to form an appropriate test pattern.

That is, the subject image of the first resolution and the test pattern of the second resolution different from the first resolution are formed on the recording medium. The second resolution corresponding to a resolution of the test pattern can be set to such a resolution as to enable visual determination of nozzle clogging regardless of (independently of) the first resolution corresponding to a resolution of the subject image. Therefore, it is possible to form an appropriate test pattern.

According to the second aspect, a resolution, for the primary scanning direction, included in the second resolution is lower than a resolution, for the primary scanning direction, included in the first resolution, or a resolution, for the secondary scanning direction, included in the second resolution is lower than a resolution, for the secondary scanning direction, included in the first resolution, or a resolution, for the primary scanning direction, included in the second resolution and a resolution, for the secondary scanning direction, included in the second resolution are lower than a resolution, for the primary scanning direction, included in the first resolution, and a resolution, for the secondary scanning direction, included in the first resolution, respectively. Therefore, when it is desired that at least one of the resolution for the primary scanning direction and the resolution for the secondary scanning direction, both of which are used for the test pattern, is set so as to be lower than the resolution of the subject image, it is possible to form an appropriate test pattern.

According to the third aspect, the first resolution enables an image to be formed in an interlace mode, and the second resolution enables an image to be formed in a non-interlace mode other than the interlace mode. When the subject image has a high resolution for enabling an image to be formed in the interlace mode, and the test pattern has a low resolution for enabling an image to be formed in the non-interlace mode, it is possible to form an appropriate test pattern.

According to the fourth aspect, first pattern storage portion previously stores first pattern information representing image information of the second resolution corresponding to the test pattern of the second resolution. Further, the first pattern information is read from the first pattern storage portion, and second pattern information representing image information of the first resolution corresponding to the test pattern of the second resolution is generated based on the first pattern information having been read. Furthermore, the test pattern of the second resolution is formed based on the second pattern information having been generated. Therefore, it is possible to form an appropriate test pattern by using a simplified configuration.

That is, the test pattern of the second resolution is formed based on the second pattern information which represents the image information of the first resolution corresponding to the test pattern. Therefore, the test pattern of the second resolution is formed based on the image information of the first resolution which is equal to the resolution of the subject image. Accordingly, the recording head (1), the primary scanning portion (2), and the secondary scanning portion (3) are instructed to perform an operation (for example, an operation based on the interlace mode) similar to an operation for forming the subject image, so as to form the test pattern.

That is, the test pattern of the second resolution is temporarily represented as (=represented as data of) the image information of the first resolution, and therefore the recording head (1), the primary scanning portion (2), and the secondary scanning portion (3) are instructed to perform an operation (for example, an operation based on the interlace mode) similar to an operation for forming the subject image, so as to form the test pattern. Therefore, it is possible to form an appropriate test pattern by using a simplified configuration.

According to the fifth aspect, when the first resolution is higher than the second resolution, image information representing a pixel at which a dot is not formed is added to the first pattern information, and an amount of the image information to be added corresponds to the number of pixels obtained by subtracting the number of pixels corresponding to the second resolution from the number of pixels corresponding to the first resolution, so that the second pattern information is generated. Therefore, it is possible to form an appropriate test pattern by using a simplified configuration.

That is, when the first resolution is higher than the second resolution, the image information representing a pixel which does not form an image of the test pattern in practice, and at which no dot is formed is added, and an amount of the image information to be added corresponds to the number of pixels corresponding to a difference between the first resolution and the second resolution (=(the first resolution)−(the second resolution)). Through this process, it is possible to generate the image information (=the second pattern information) which temporarily have the number of pixels corresponding to the first resolution, and apparently represents the same test pattern as the test pattern of the second resolution.

According to the sixth aspect, second pattern storage portion (414) previously stores second pattern information representing image information of the first resolution corresponding to the test pattern of the second resolution, and the second pattern information is generated based on first pattern information representing image information of the second resolution corresponding to the test pattern of the second resolution. Further, the second pattern information stored in the second pattern storage portion (414) is read, and the test pattern of the second resolution is formed based on the second pattern information having been read. Therefore, it is unnecessary to perform a process for generating the second pattern information, so that an appropriate test pattern can be formed with enhanced efficiency.

According to the seventh aspect, a plurality of pieces of image information each corresponding to the test pattern of the second resolution are previously stored, in the second pattern storage portion (414), so as to be associated with a plurality of resolutions, respectively, which are previously set. Further, an operation input is received from an outside, and one of the plurality of resolutions is set as the first resolution based on the operation input having been received. Furthermore, one of the plurality of pieces of image information associated with the one of the plurality of resolutions having been set as the first resolution is read from the second pattern storage portion (414), and the test pattern of the second resolution is formed based on the one of the plurality of pieces of image information having been read. Therefore, the image information of the resolution which is equal to a resolution set as the resolution (=the first resolution) of the subject image is read as the image information of the test pattern so as to form the test pattern, thereby enabling an appropriate test pattern to be formed with enhanced efficiency.

According to the eighth aspect, second pattern storage portion (414) previously stores second pattern information representing image information of the first resolution corresponding to the test pattern of the second resolution, and the second pattern information is generated based on first pattern information representing image information of the second resolution corresponding to the test pattern of the second resolution. The second pattern information is combined with image information corresponding to the subject image of the first resolution so as to generate combined image information as one piece of image information, and the subject image of the first resolution and the test pattern of the second resolution are formed based on the combined image information having been generated. Therefore, it is possible to form an appropriate test pattern with enhanced efficiency.

That is, the subject image and the test pattern which have the resolutions different from each other are both represented as the image information of the first resolution. The two pieces of image information of the first resolution are combined with each other so as to generate combined image information as one piece of image information, and the subject image and the test pattern are formed based on the combined image information having been generated. Therefore, an operation of an apparatus for forming the subject image and the test pattern can be the same as an operation for forming an image corresponding to one piece of image information of the first resolution, thereby enabling an appropriate test pattern to be formed with enhanced efficiency.

According to the ninth aspect, combined image storage portion previously stores combined image information corresponding to one piece of image information generated by combining second pattern information with image information corresponding to the subject image of the first resolution, and the second pattern information represents image information of the first resolution corresponding to the test pattern of the second resolution, and is generated based on first pattern information representing image information of the second resolution corresponding to the test pattern of the second resolution. The combined image information stored in the combined image storage portion is read, and the subject image of the first resolution and the test pattern of the second resolution are formed based on the combined image information having been read. Therefore, it is unnecessary to perform a process for combining the second pattern information with the image information corresponding to the subject image of the first resolution, thereby enabling an appropriate test pattern to be formed with enhanced efficiency.

According to the tenth aspect, the test pattern includes a test pattern generated by a specific dot forming section which is previously set and is at least one of the plurality of dot forming sections aligned in the recording head (1) in the secondary scanning direction. Therefore, it is possible to form an appropriate test pattern having improved usability.

That is, for example, when a dot forming section (hereinafter, referred to as a "faulty dot forming section") which is not able to form a dot appears, a position corresponding to the faulty dot forming section is compared, in the formed test pattern, with a position corresponding to the specific dot forming section. Thus, it is possible to identify the faulty dot forming section among the plurality of dot forming sections aligned in the recording head (1) in the secondary scanning direction. Therefore, it is possible to form an appropriate test pattern having improved usability.

According to the eleventh aspect, the specific dot forming section is at least one of dot forming sections positioned on both ends of the recording head (1), among the plurality of dot forming sections aligned in the recording head (1) in the secondary scanning direction. Therefore, when, for example, a dot forming section (hereinafter, referred to as a "faulty dot forming section") which is not able to form a dot appears, the faulty dot forming section can be identified with enhanced easiness. Therefore, it is possible to form an appropriate test pattern having improved usability.

According to the twelfth aspect, the test pattern is an almost rectangular pattern having sides extending in the primary scanning direction and sides extending in the secondary scanning direction, and the test pattern generated by the specific dot forming section projects from one of the sides extending in the secondary scanning direction, and the one of the sides corresponds to a part of a rectangle forming an outer edge of the test pattern. Therefore, it is possible to easily identify a position, in the test pattern, corresponding to the specific dot forming section in a visual manner. Therefore, it is possible to identify the faulty dot forming section with enhanced easiness, and it is possible to form an appropriate test pattern having improved usability.

According to the thirteenth aspect, the test pattern is formed at a position distanced by a predetermined distance in the primary scanning direction from the area in which the subject image on the recording medium is formed. Therefore, for example, even when a dot forming section (hereinafter, referred to as a "faulty dot forming section") which is not able to form a dot appears while the subject image is being formed, the faulty dot forming section can be visually identified. Accordingly, it is possible to form an appropriate test pattern having improved usability.

According to the fourteenth aspect, the recording head (1), the primary scanning portion (2), and the secondary scanning portion (3) are instructed to form a subject image of a first resolution which is previously set, and the recording head (1), the primary scanning portion (2), and the secondary scanning portion (3) are instructed to form, in an area other than an area in which the image on the recording medium is formed, a test pattern of a second resolution which is previously set and is different from the first resolution. Therefore, it is possible to form an appropriate test pattern.

That is, the subject image of the first resolution and the test pattern of the second resolution different from the first resolution are formed on the recording medium. The second resolution corresponding to a resolution of the test pattern can be set to such a resolution as to enable visual determination of nozzle clogging regardless of (independently of) the first resolution corresponding to a resolution of the subject image. Therefore, it is possible to form an appropriate test pattern.

These and other objects, features, aspects and advantages of the present invention will become more apparent from the following detailed description of the present invention when taken in conjunction with the accompanying drawings.

BRIEF DESCRIPTION OF THE DRAWINGS

FIG. 12A shows a table representing an exemplary content of the second pattern information stored in a pattern storage section;

FIG. 12B is a diagram illustrating exemplary image information (=second pattern information) of a first resolution corresponding to the test pattern (rectangular pattern) in a case where the first resolution is set such that a resolution for the primary scanning direction is 300 dpi, and a resolution for the secondary scanning direction is 300 dpi;

FIG. 12C is a diagram illustrating exemplary image information (=second pattern information) of a first resolution corresponding to the test pattern (rectangular pattern) in a case where the first resolution is set such that a resolution for the primary scanning direction is 600 dpi, and a resolution for the secondary scanning direction is 150 dpi;

DESCRIPTION OF THE PREFERRED EMBODIMENTS

Figure 1:
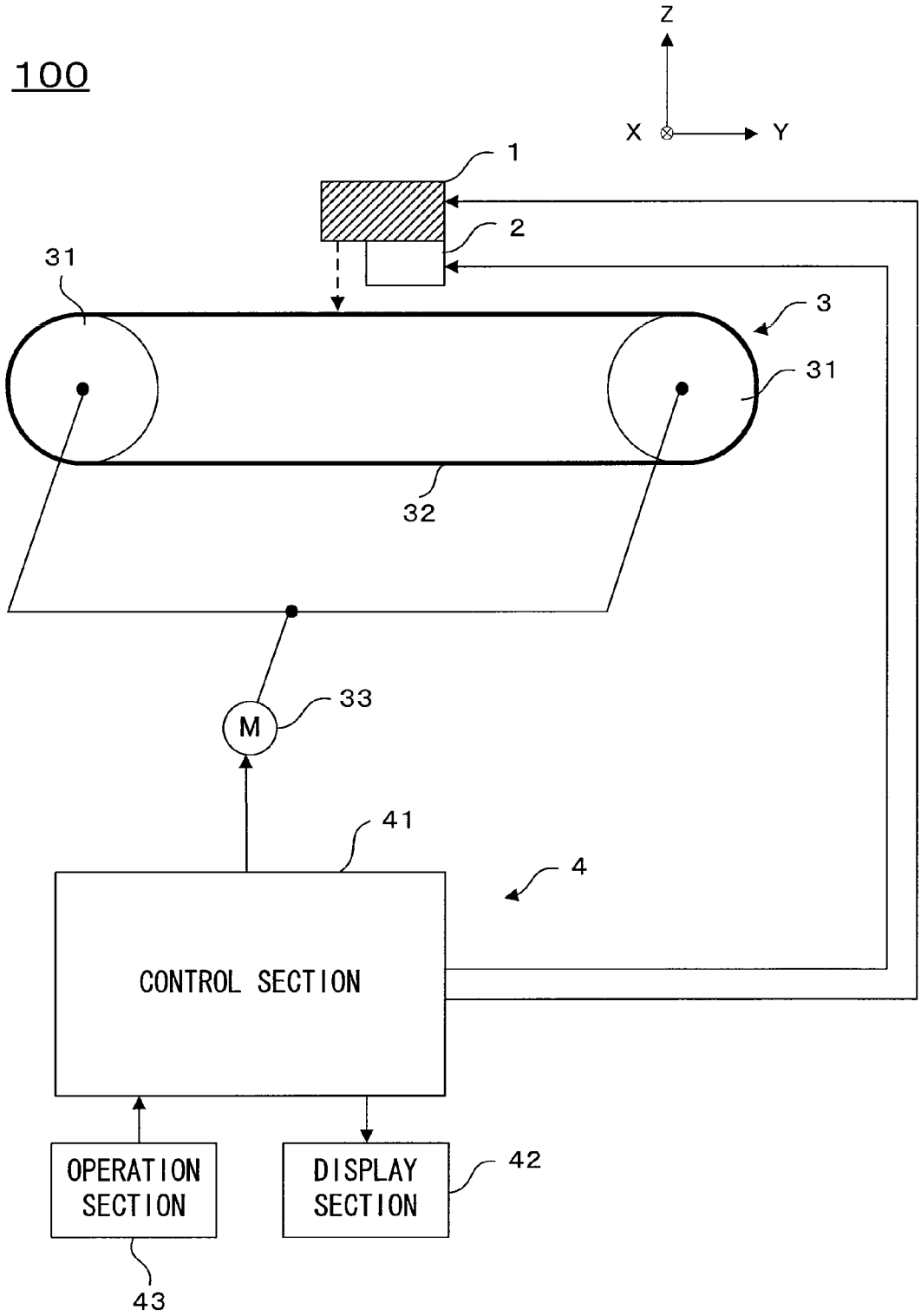
FIG. 1 is a block diagram illustrating an exemplary configuration of an ink-jet recording apparatus according to the present invention.

Hereinafter, an embodiment of an image forming apparatus according to the present invention will be described with reference to the drawings. FIG. 1 is a block diagram illustrating an exemplary configuration of an ink-jet recording apparatus (corresponding to the image forming apparatus) according to the present invention. As shown in FIG. 1, an ink-jet recording apparatus 100 includes a recording head 1, a head driving section 2, a medium driving section 3, and a controller 4. As shown in FIG. 1, an X-axis, a Y-axis, and a Z-axis are defined so as to represent a direction orthogonal to paper, a rightward direction, and an upward direction, respectively.

Figure 2A:
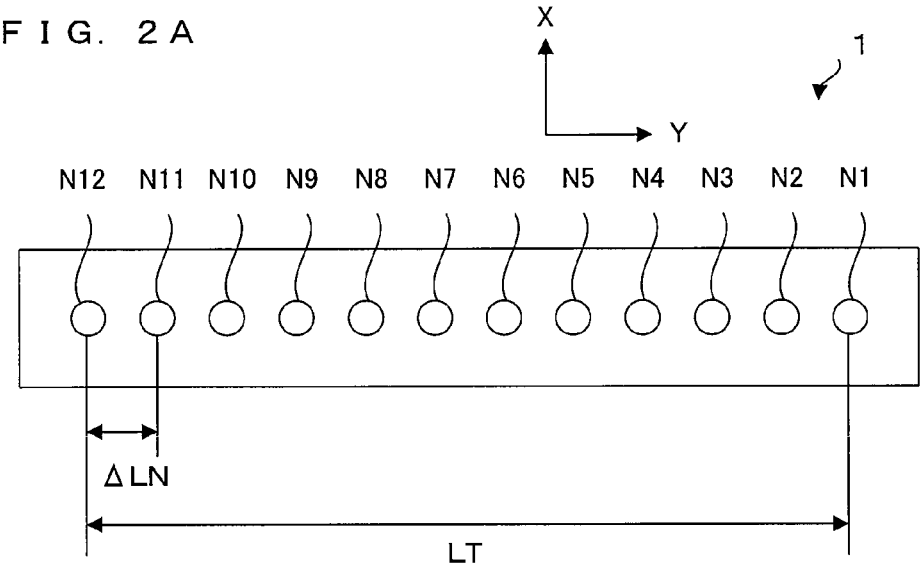
FIG. 2A is a bottom view of an exemplary alignment of nozzles provided in a recording head shown in FIG. 1.

As shown in FIG. 2A, the recording head 1 has a plurality (12 in the present embodiment) of nozzles (each corresponding to a dot forming section) aligned in a secondary scanning direction (corresponding to the Y-axis direction in the drawings). Further, the recording head 1 forms an image on a recording medium by applying, to the recording medium such as recording paper, ink discharged from the nozzles. In the present embodiment, an image on the recording medium is formed by dots aligned in a primary scanning direction (the X-axis direction in the drawings) and the secondary scanning direction (the Y-axis direction in the drawings), and the dots are formed by the ink discharged from the nozzles being applied to the recording medium. Further, whether or not the ink is to be discharged from the nozzles (=whether or not the dots are to be formed) is controlled in accordance with an instruction from the controller 4.

The head driving section 2 (corresponding to primary scanning portion) includes, for example, a linear motor, and moves the recording head 1 in the primary scanning direction (the X-axis direction in the drawings) in accordance with an instruction from the controller 4.

The medium driving section 3 (corresponding to secondary scanning portion) moves a recording medium in the secondary scanning direction (the Y-axis direction in the drawings) in accordance with an instruction from the controller 4. Further, the medium driving section 3 includes a conveyor roller 31, a conveyor belt 32, and a conveyor motor 33. The conveyor roller 31 is a pair of rollers driven by the convey or motor 33. The conveyor belt 32 is a belt which stretches between the pair of rollers (the conveyor roller 31), and a recording medium is loaded on the upper surface of the conveyor belt 32. Further, the conveyor belt 32 is driven by the conveyor roller 31, and moves the recording medium in the secondary scanning direction (the Y-axis direction in the drawings). The conveyor motor 33 is, for example, a DC motor, and is used for moving the recording medium by means of the conveyor roller 31 and the conveyor belt 32 in accordance with an instruction from the controller 4.

The controller 4 is, for example, a personal computer, and controls operations of the recording head 1, the head driving section 2, the medium driving section 3, and the like. Further, the controller 4 includes a control section 41, a display section 42, and an operation section 43. The control section 41 includes the CPU (Central Processing Unit), a RAM (Random Access Memory), a ROM (Read Only Memory), and the like. Further, the control section 41 controls operations of the recording head 1, the head driving section 2, the medium driving section 3, and the like. The display section 42 includes an LCD (Liquid Crystal Display) and the like, and displays, in a visual manner, character information and the like in accordance with an instruction from the control section 41. The operation section 43 (corresponding to a part of resolution setting portion) is, for example, a keyboard or a mouse, and receives an operation input from the outside, and outputs the received operation input to the control section 41.

In the present embodiment, the image forming apparatus is an ink-jet recording apparatus. However, the image forming apparatus may be another type of image forming apparatus. For example, the image forming apparatus may be an apparatus for forming an image on a recording medium by using LEDs (Light Emitting Diodes) or the like instead of the nozzles. Further, although in the present embodiment the image forming apparatus is a monochrome ink-jet recording apparatus, the image forming apparatus may be a color ink-jet recording apparatus.

Figure 2B:
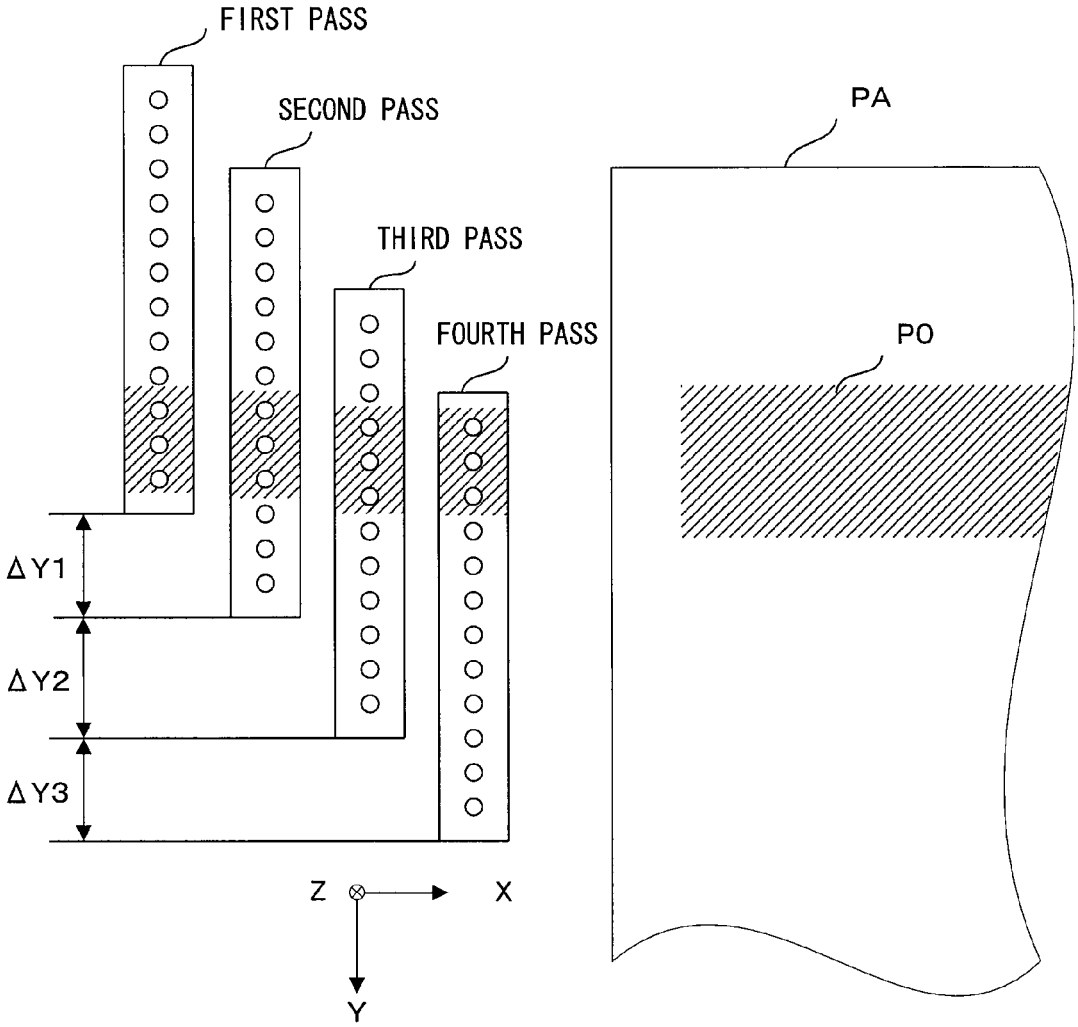
FIG. 2B is a diagram illustrating an exemplary interlace mode.

FIG. 2A is a bottom view of an exemplary alignment of nozzles provided in the recording head 1 shown in FIG. 1, and FIG. 2B is a diagram illustrating an exemplary interlace mode. FIG. 2A is a bottom view of an exemplary alignment of nozzles provided in the recording head 1 shown in FIG. 1. As shown in FIG. 2A, the recording head 1 has 12 nozzles N1 to N12 aligned in line in the Y-axis direction. The nozzles N1 to N12 are aligned such that a distance (nozzle pitch $\Delta LN$ in the present embodiment) between nozzle centers of any two adjacent nozzles is constant. In the present embodiment, the nozzle pitch $\Delta LN$ is set to 0.169 mm (=25.4/150), which represents a pitch corresponding to a reference resolution 150 dpi (dot per inch) for the secondary scanning direction. Further, a distance between the nozzle centers of the nozzle N1 and the nozzle N12 provided on both ends, respectively, of the recording head 1 is represented as LT (LT=ΔLN×11). The reference resolution for the primary scanning direction of the ink-jet recording apparatus 100 is 300 dpi.

Next, an exemplary interlace mode will be described with reference to FIGS. 2B, 3, 4A, 4B, 5A, and 5B. As shown in FIG. 2B, an image P0 is formed on a recording medium PA through four passes (the number PN of passes=4) from the first pass to the fourth pass. The resolution of the image P0 is set to 600 dpi for the primary scanning direction, and the resolution thereof is set to 300 dpi for the secondary scanning direction. In the second pass, the movement of the recording head 1 in the primary scanning direction (the X-axis direction in the drawings) is performed at a position distanced by a distance ΔY1 in the secondary scanning direction (the Y-axis direction in the drawings) from a position at which the movement of the recording head 1 in the primary scanning direction is performed in the first pass. In the third pass, the movement of the recording head 1 in the primary scanning direction (the X-axis direction in the drawings) is performed at a position distanced by a distance ΔY2 in the secondary scanning direction (the Y-axis direction in the drawings) from a position at which the movement of the recording head 1 in the primary scanning direction is performed in the second pass. In the fourth pass, the movement of the recording head 1 in the primary scanning direction (the X-axis direction in the drawings) is performed at a position distanced by a distance ΔY3 in the secondary scanning direction (the Y-axis direction in the drawings) from a position at which the movement of the recording head 1 in the primary scanning direction is performed in the third pass.

The distances ΔY1, ΔY2, and ΔY3 are calculated by using equations (1), (2), and (3), respectively, as follows.

$$\begin{aligned}\Delta Y1 &= (\text{the number of nozzles})/(\text{the number } PN \text{ of passes}) \times \\ &\quad \text{the nozzle pitch } \Delta LN \\ &= 12/4 \times 0.169 \\ &= 0.508 \text{ (mm)}\end{aligned} \tag{1}$$

$$\begin{aligned}\Delta Y2 &= (\text{the number of nozzles})/(\text{the number } PN \text{ of passes}) \times \\ &\quad \text{the nozzle pitch } \Delta LN + \\ &\quad (25.4/(\text{resolution for the secondary scanning direction})) \\ &= 12/4 \times 0.169 + (25.4/300) \\ &= 0.593 \text{ (mm)}\end{aligned} \tag{2}$$

$$\begin{aligned}\Delta Y3 &= (\text{the number of nozzles})/(\text{the number } PN \text{ of passes}) \times \\ &\quad \text{the nozzle pitch } \Delta LN \\ &= 12/4 \times 0.169 \\ &= 0.508 \text{ (mm)}\end{aligned} \tag{3}$$

Figure 3:
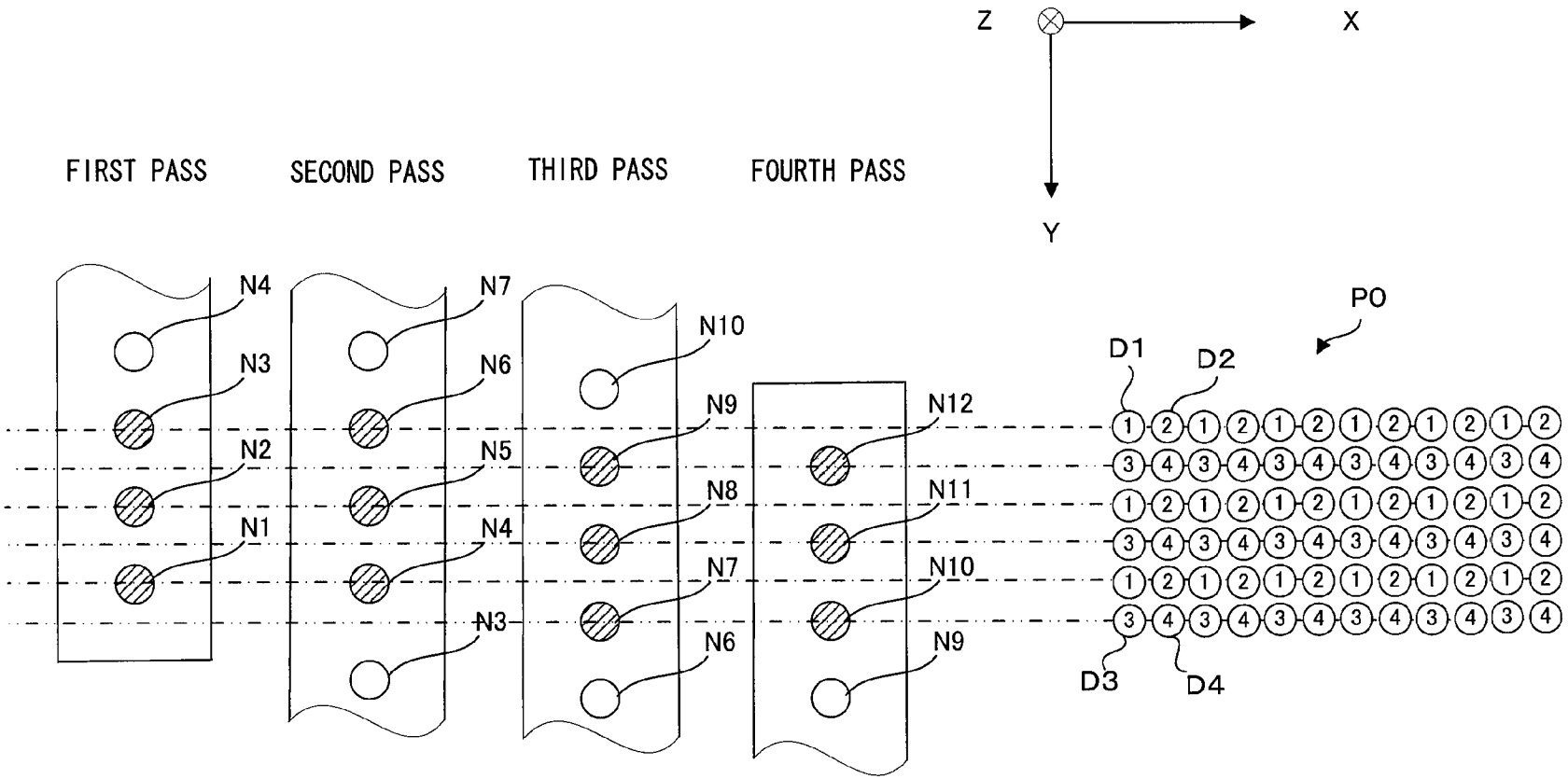
FIG. 3 is a diagram illustrating an exemplary correspondence between each nozzle and dots in the interlace mode.

FIG. 3 is a diagram illustrating an exemplary correspondence between each nozzle and the dots in the interlace mode. As shown in FIG. 3, in the first pass, among dots D1 to D4 of the image P0, the dots D1 (dots represented as 1 which is encircled with a circle ○ in the drawings) are formed by the nozzles N1 to N3. In the second pass, among the dots D1 to D4 of the image P0, the dots D2 (dots represented as 2 which is encircled with the circle ○ in the drawings) are formed by the nozzles N4 to N6. Further, in the third pass, among the dots D1 to D4 of the image P0, the dots D3 (dots represented as 3 which is encircled with the circle ○ in the drawings) are formed by the nozzles N7 to N9. Furthermore, in the fourth pass, among the dots D1 to D4 of the image P0, the dots D4 (dots represented as 4 which is encircled with the circle ○ in the drawings) are formed by the nozzles N10 to N12.

Figure 4A:
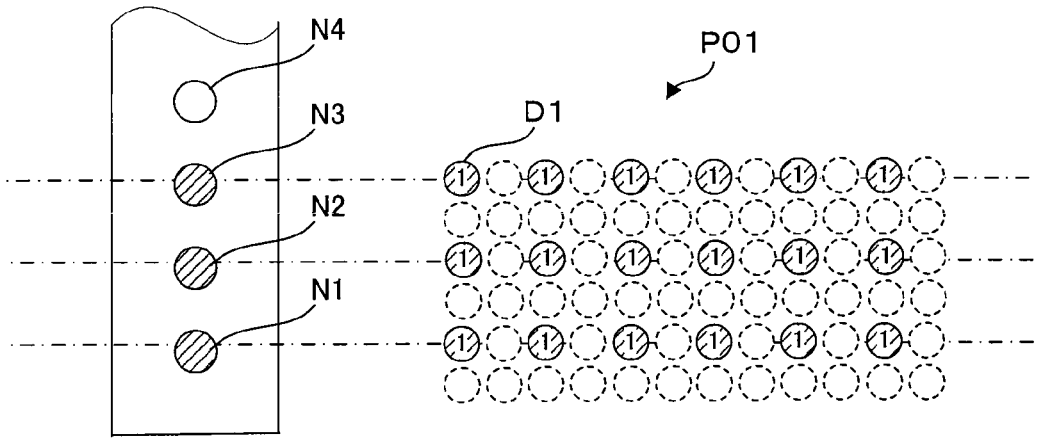
FIG. 4A is a diagram illustrating an exemplary correspondence between each nozzle and dots for a first pass and a second pass.
Figure 4B:
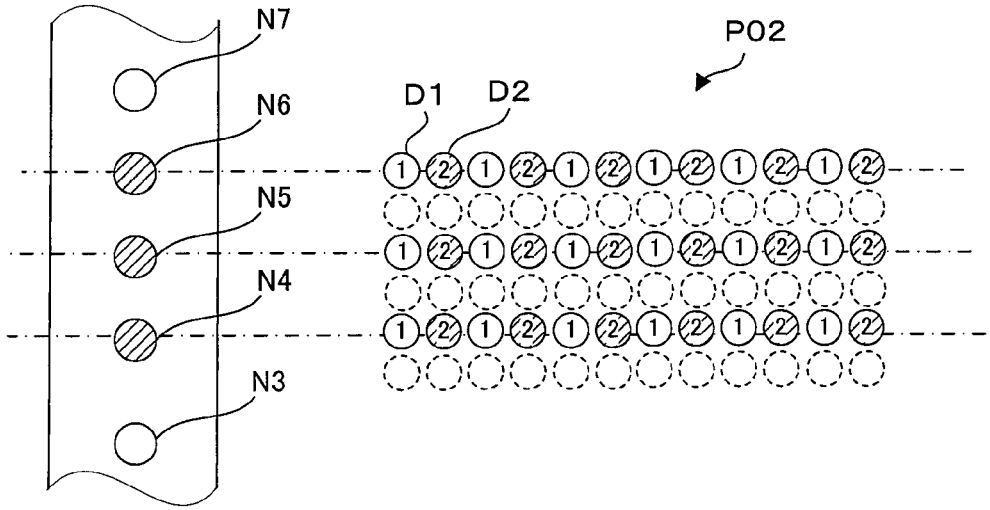
FIG. 4B is a diagram illustrating an exemplary correspondence between each nozzle and dots for the first pass and the second pass.

FIG. 4A, FIG. 4B, FIG. 5A, and FIG. 5B are diagrams illustrating an exemplary correspondence between each nozzle and the dots in the first to the fourth passes, respectively. Firstly, as shown in FIG. 4A, the dots D1 (dots represented as 1 which is encircled with the circle ○ in the drawings) are formed by the nozzles N1 to N3, and an image P01 composed of only the dots D1 included in the image P0 is generated. Next, as shown in FIG. 4B, the dots D2 (dots represented as 2 which is encircled with the circle ○ in the drawings) are formed by the nozzles N4 to N6, and an image P02 composed of the dots D1 and the dots D2 included in the image P0 is generated.

Figure 5A:
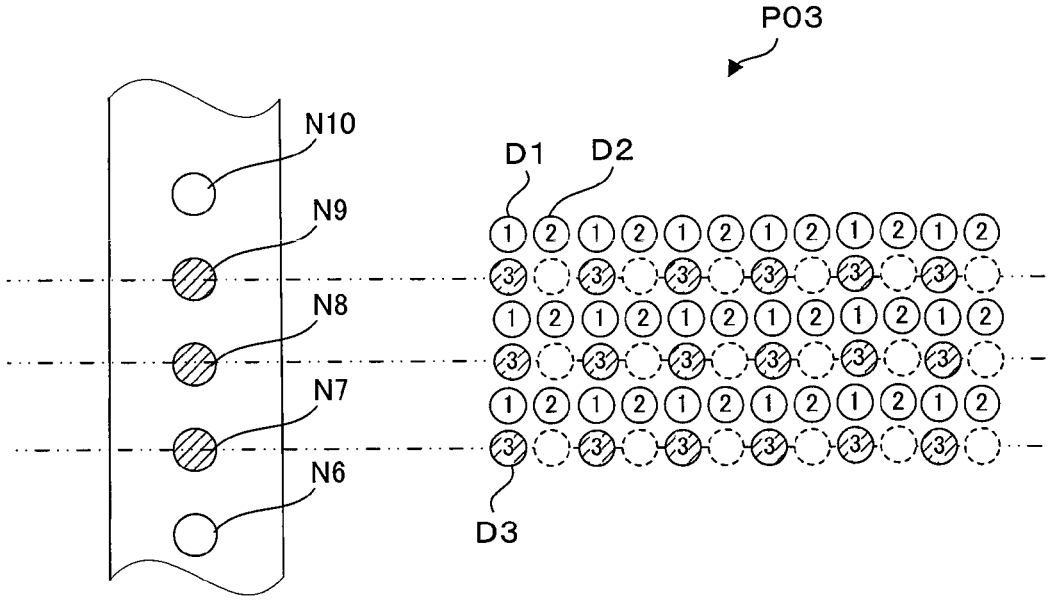
FIG. 5A is a diagram illustrating an exemplary correspondence between each nozzle and dots for a third pass and a fourth pass.
Figure 5B:
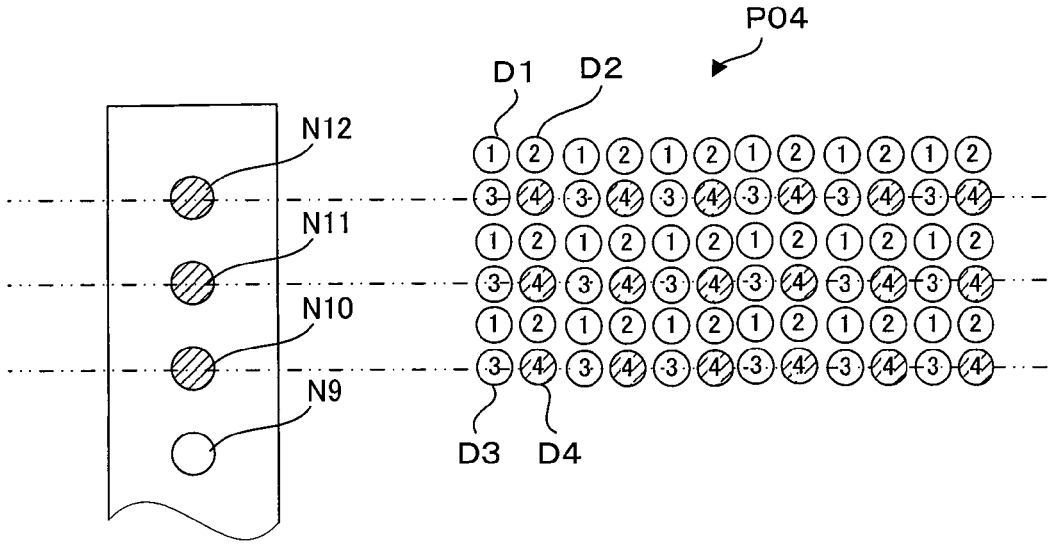
FIG. 5B is a diagram illustrating an exemplary correspondence between each nozzle and dots for the third pass and the fourth pass.

Further, as shown in FIG. 5A, the dots D3 (dots represented as 3 which is encircled with the circle ○ in the drawings) are formed by the nozzles N7 to N9, and an image P03 composed of the dots D1, the dots D2, and the dots D3 included in the image P0 is generated. Finally, as shown in FIG. 5B, the dots D4 (dots represented as 4 which is encircled with the circle ○ in the drawings) are formed by the nozzles N10 to N12, thereby generating an image P04 (=the image P0).

Figure 6A:
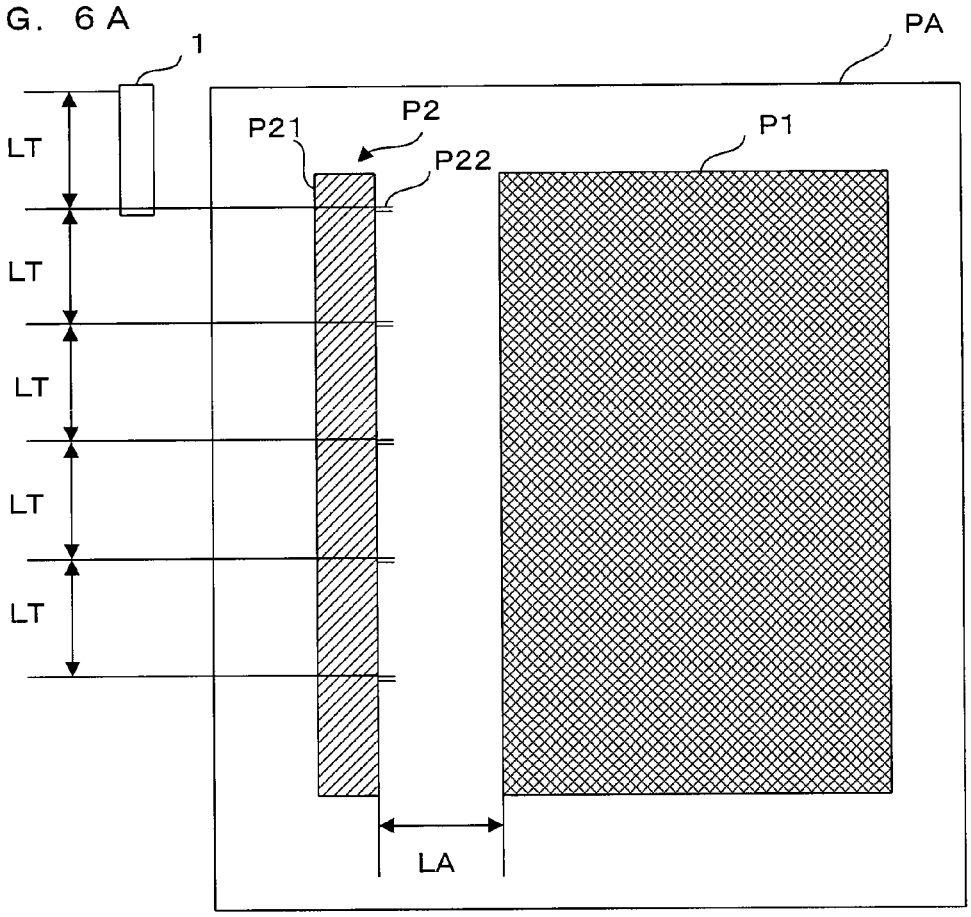
FIG. 6A is a diagram illustrating an exemplary subject image and an exemplary test pattern which are formed by the ink-jet recording apparatus according to the present invention.
Figure 6B:
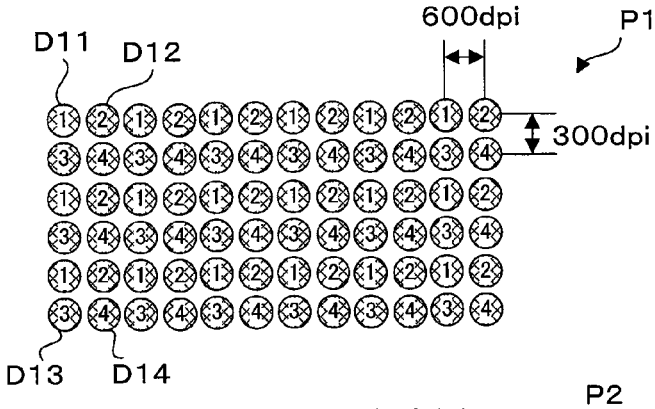
FIG. 6B is a diagram illustrating an exemplary resolution of the subject image.
Figure 6C:
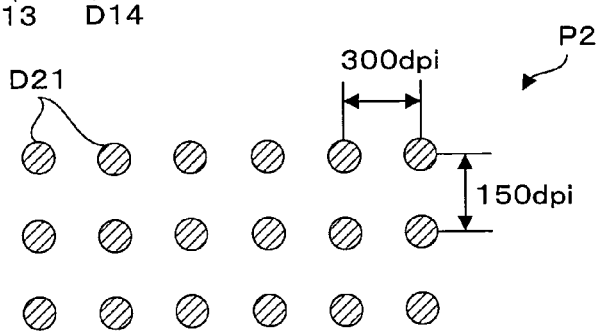
FIG. 6C is a diagram illustrating an exemplary resolution of the test pattern (rectangular pattern)

FIGS. 6A, 6B, and 6C are diagram illustrating an exemplary subject image P1 and an exemplary test pattern P2 formed by the ink-jet recording apparatus 100 according to the present invention. The subject image P1 is an image desired by a user to be formed on the recording medium PA. The test pattern P2 is an image formed on the recording medium PA so as to allow visual checking or the like as to whether or not the nozzle clogging or the like occurs in any of the nozzles N1 to N12 shown in FIG. 2A.

As shown in FIG. 6A, the test pattern P2 is formed at a position distanced, from an area in which the subject image P1 on the recording medium PA is formed, by a predetermined distance LA in the primary scanning direction (the lateral direction in the drawings). Further, the test pattern P2 is an almost rectangular pattern having sides extending in the primary scanning direction (the lateral direction in the drawings) and sides extending in the secondary scanning direction (the vertical direction in the drawings). The test pattern P2 has a rectangular pattern P21 and projection patterns P22. The test pattern P2 generated by each of the nozzles N1 and N12 projects from a side (the right side in this example) which extends in the secondary scanning direction (the vertical direction in the drawings) and which is a part of a rectangle forming an outer edge of the rectangular pattern P21, so as to form the projection patterns P22. Further, the rectangular pattern P21 is used for allowing, for example, visual checking as to whether or not nozzle clogging or the like occurs in any of the nozzles N1 to N12.

As describe above, the test pattern P2 has the projection patterns P22, and therefore it is possible to easily identify a clogging nozzle (corresponding to a faulty dot forming section) among the nozzles N1 to N12 shown in FIG. 2 when nozzle clogging occurs.

Further, the test pattern P2 is formed at a position distanced, from an area in which the subject image P1 on the recording medium PA is formed, by a predetermined distance LA in the primary scanning direction. For example, also when the nozzle clogging occurs while the subject image P1 is being formed, it is possible to visually determine the nozzle clogging. Therefore, the test pattern P2 having improved usability can be formed.

In the present embodiment, the projection patterns P22 are formed by the nozzle N1 and the nozzle N12. However, the projection pattern P22 may be formed by at least one of the nozzle N1 and the nozzle N12. Alternatively, the projection pattern P22 may be formed by another nozzle/other nozzles (for example, the nozzle N6 and the nozzle N7).

In the present embodiment, the test pattern P2 is formed at a position (on the left side of the drawing) distanced, from an area in which the subject image P1 on the recording medium PA is formed, by a predetermined distance LA in the primary scanning direction. However, the test pattern P2 may be formed to the right of the area in which the subject image P1 is formed. Alternatively, the test pattern P2 may be divided into two so as to be formed to the right and the left of the area in which the subject image P1 is formed. In this case, even when a sufficient area in which the test pattern P2 is to be formed is not provided to at least one of the right and the left of the area in which the subject image P1 is formed, the test pattern P2 can be formed. Further, the test pattern P2 may be formed above, below or both above and below an area in which the subject image P1 is formed. In this case, even when a sufficient area in which the test pattern P2 is to be formed is not provided to the right or the left of the area in which the subject image P1 is formed, the test pattern P2 can be formed.

FIGS. 6B and 6C are diagrams illustrating exemplary resolutions of the subject image P1 and the test pattern P2 (the rectangular pattern P21), respectively. As shown in FIG. 6B, the subject image P1 is formed by using the interlace mode, and the number PN of passes to be used is four, as described for the image P0 shown in FIG. 3, and the resolution for the primary scanning direction (the lateral direction in the drawings) is 600 dpi, and the resolution for the secondary scanning direction (the vertical direction in the drawings) is 300 dpi (the resolutions represent the first resolution: the resolution for the primary scanning direction=600 dpi, and the resolution for the secondary scanning direction=300 dpi). On the other hand, in the test pattern P2 (the rectangular pattern P21), the resolution for the primary scanning direction (the lateral direction in the drawings) is 300 dpi, and the resolution for the secondary scanning direction (the vertical direction in the drawing) is 150 dpi (the resolutions represent the second resolution: the resolution for the primary scanning direction=300 dpi, and the resolution for the secondary scanning direction=150 dpi).

Conventionally, the resolution of the test pattern P2 is equal to the resolution of the subject image. However, when the test pattern P2 is recorded during the interlace-scanning, the following problems arise. Specifically, even when an operator finds, in the test pattern P2, an image fault (fading in image or the like) caused due to nozzle clogging or the like, it is substantially difficult to identify a clogging nozzle which has caused the image fault. The ink-jet recording apparatus 100 according to the present invention forms, on the recording medium PA, the test pattern P2 which has a resolution different from the subject image P1, as shown in FIG. 6.

Figure 7:
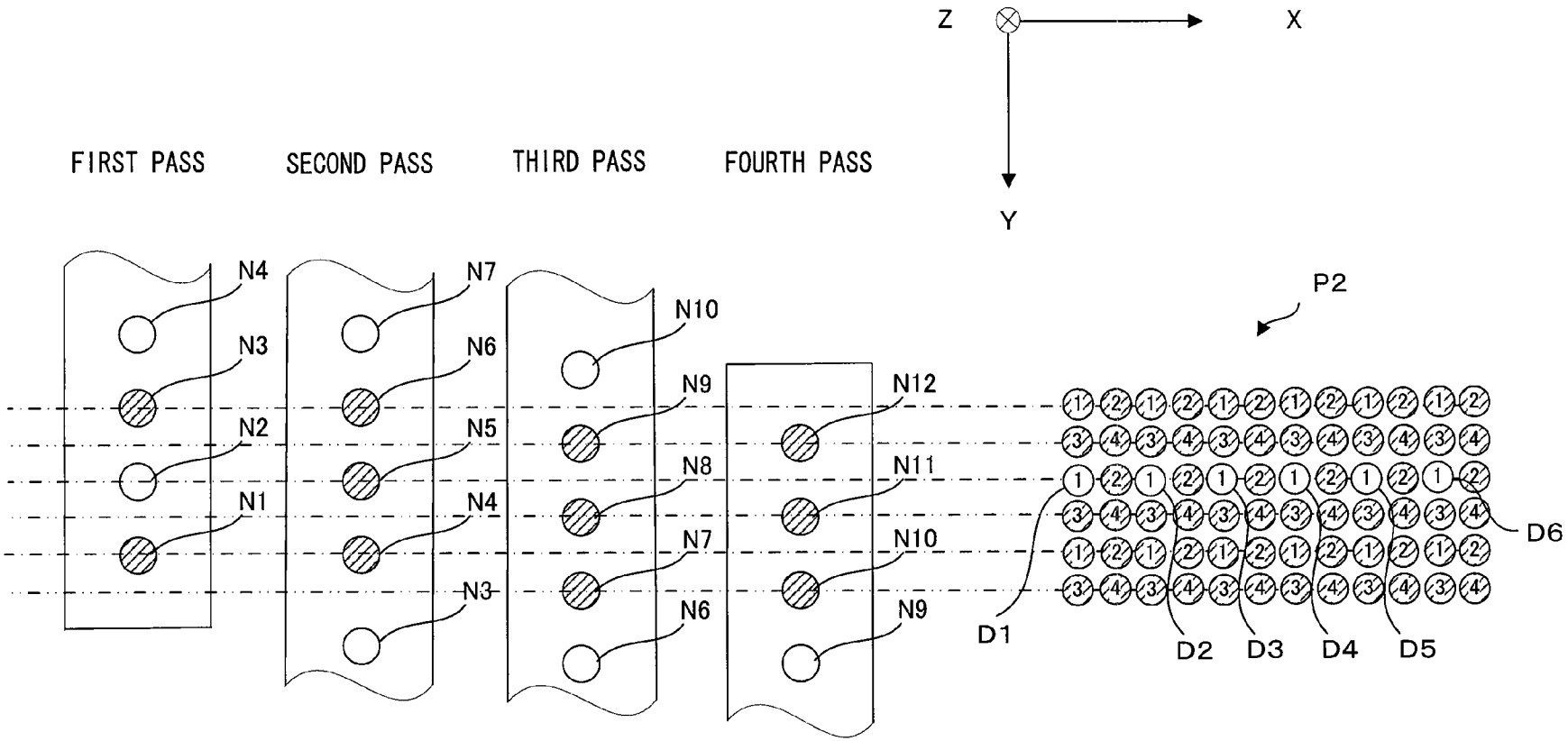
FIG. 7 is a diagram illustrating an exemplary test pattern formed by a conventional ink-jet recording apparatus when a nozzle N2 malfunctions.

A case where the resolution of the test pattern P2 is equal to the resolution of the subject image P1 will be described. It is assumed that in this case the nozzle N2 malfunctions. In this case, the test pattern P2 as shown in FIG. 7 is formed. That is, an image (hereinafter, referred to as "image fault") is formed such that the dots D1 to D6 are missing (or are faded) from all the dots of the test pattern P2. For example, the operator needs to visually check the test pattern P2, so as to identify a nozzle which corresponds to a position at which the image fault occurs. However, the test pattern P2 is formed by using the interlace-scanning, and this work is substantially difficult.

Figure 8:
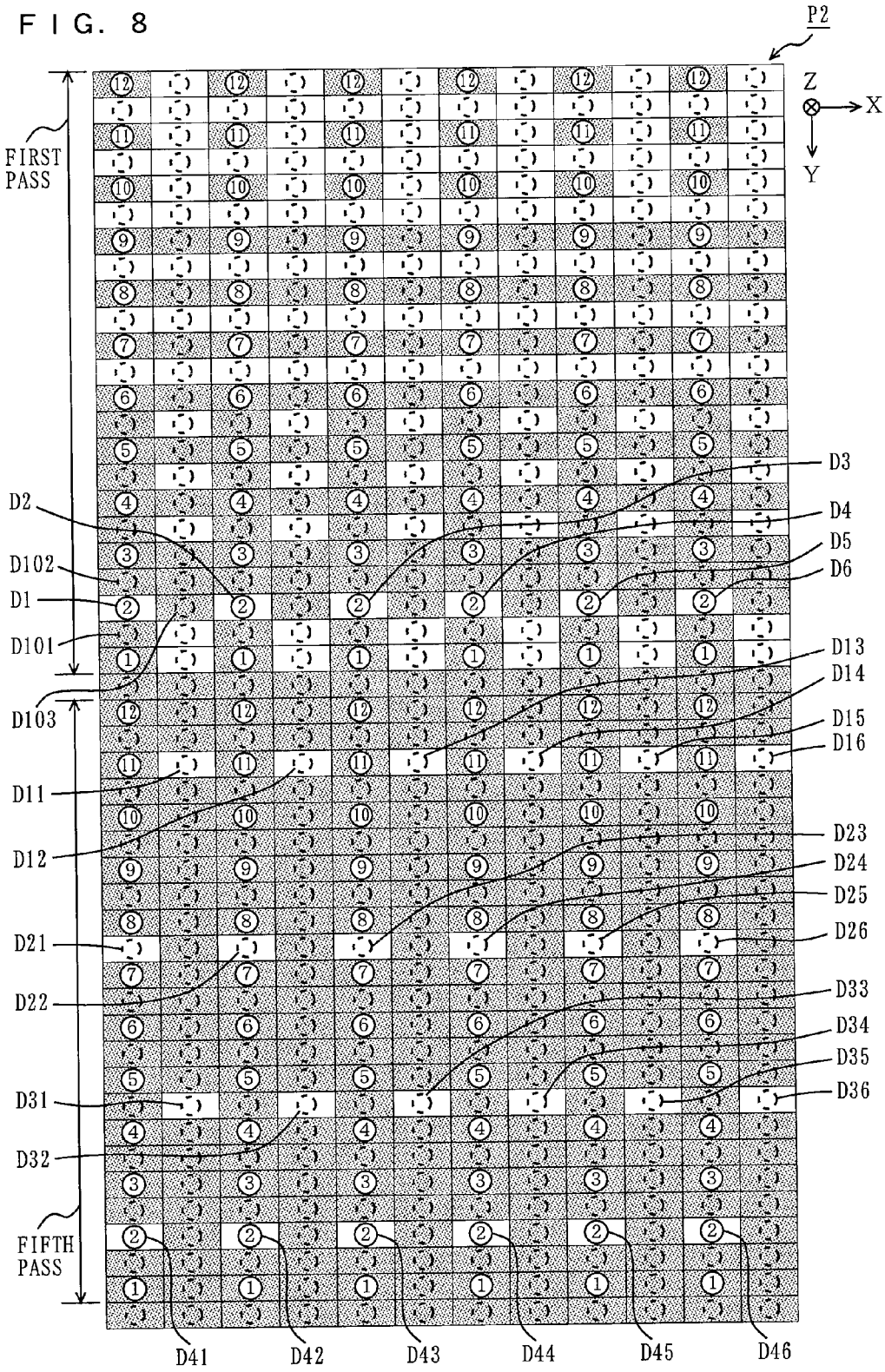
FIG. 8 is a schematic diagram illustrating in detail the test pattern shown in FIG. 7.

This will be described in detail with reference to FIG. 8. FIG. 8 is a schematic diagram illustrating the test pattern P2 obtained through the first pass to the eighth pass. A range indicated by arrows denoted by the reference numeral, "first pass", represents positions which are scanned by the recording head 1 in the secondary scanning direction when an image is recorded in the first pass. Similarly, a range indicated by arrows denoted by the reference numeral, "fifth pass", represents positions which are scanned by the recording head 1 in the secondary scanning direction when an image is recorded in the fifth pass.

In FIG. 8, a circle ○ including a number therein represents a dot, and the number encircled with the circle ○ represents a number of a nozzle which records the dot. For example, a dot represented as the circle ○ including a number, 1, is formed by the nozzle N1. The numbers each encircled with the circle ○ represent only dots which are recorded in the first pass or the fifth pass, and the numbers of the nozzles which correspond to the dots recorded in the second to the fourth passes, and the sixth to the eighth passes are not shown for the sake of convenience.

In the drawing (FIG. 8), painted dots are dots to which ink is actually put, and represent correctly formed dots. On the other hand, unpainted dots (dots D1 to D6, D11 to D16, D21 to D26, D31 to D36, and D41 to D46) are dots onto which ink is not correctly discharged due to the malfunction of a nozzle although the dots are to be actually formed.

It is difficult to identify nozzles which record the dots, respectively, because the ink-jet recording apparatus 100 performs the interlace-scanning. For example, identification of a nozzle recording the dot D1 is performed in the following manner.

Firstly, an operator measures a distance from an appropriate reference position on the test pattern P2 to the dot D1 in the secondary scanning direction and the primary scanning direction. On the test pattern P2, a dot D101 or a dot D102 adjacent, in the secondary scanning direction, to the dot D1 at which the image fault occurs may be incorrectly determined as a dot at which the image fault occurs. Therefore, instead of the nozzle N2 for forming the dot D1 in the first pass, a nozzle (the nozzle N8 or the nozzle N9 in the third pass) for forming the dot D101 or the dot D102, respectively, may be incorrectly determined as the malfunctioning nozzle.

Similarly, on the test pattern P2, ink is also put on a dot D103 adjacent, in the primary scanning direction, to the dot D1 at which the image fault occurs. Therefore, an operator may incorrectly measure the position of the dot D1 in the primary scanning direction, and incorrectly determine that the image fault occurs not at the dot D1 but at the dot D103. That is, it is incorrectly determined that the malfunctioning nozzle is not the nozzle N2 for forming the dot D1 in the first pass but the nozzle N5 (see FIG. 7) for forming the dot D103 in the second pass.

As described above, in the conventional test pattern, it is necessary to accurately measure, in the primary scanning direction and the secondary scanning direction, a position at which the image fault occurs, and therefore it is substantially difficult to identify a nozzle which causes the image fault.

Further, since dots (the dots D101, D102, and D103) to which ink is correctly put are formed adjacent to the dot (for example, the dot D1) at which the image fault occurs, it is difficult to determine a dot at which the image fault occurs in a visual manner or the like.

Further, an operator needs to be acquainted with the interlace-scanning mode. For example, an operator, who is not acquainted with the interlace-scanning, is likely to associate the image fault occurring at the dots D11 to D16 with the nozzle N11 instead of the nozzle N2 which actually causes the image fault (because the positions of the dots D11 to D16 in the secondary scanning direction correspond to the nozzle N11 in the fifth pass).

Further, an apparatus which selectively performs a plurality of types of interlace-scannings requires an operator to have advanced knowledge of the interlace-scanning mode.

Figure 9:
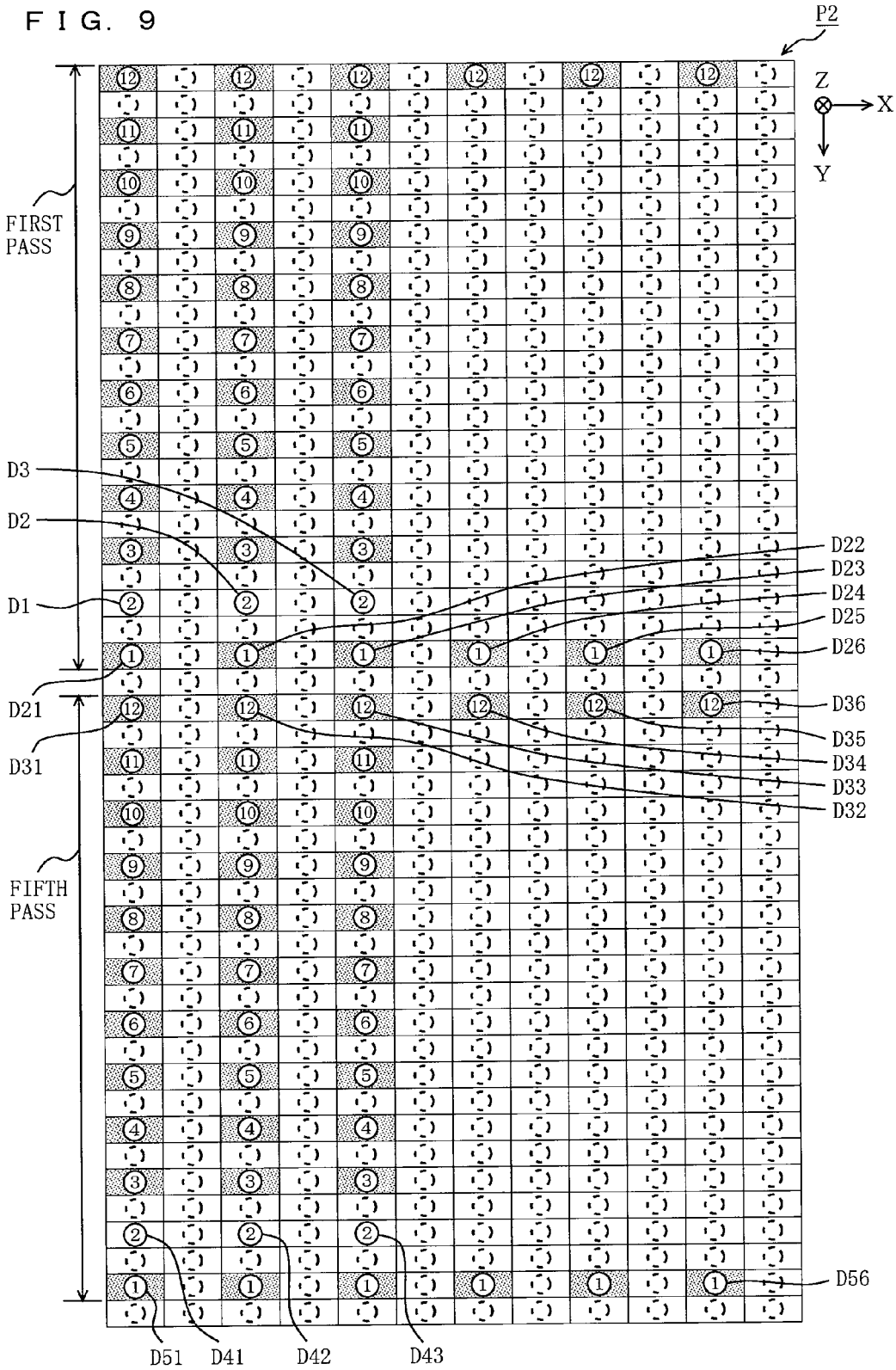
FIG. 9 is a schematic diagram illustrating an exemplary test pattern formed by the ink-jet recording apparatus according to the present invention.

FIG. 9 is a schematic diagram illustrating a test pattern according to the present invention. Also in FIG. 9, a circle ○ including a number therein represents a dot, and the number encircled with the circle ○ represents a number of a nozzle which records the dot. For example, a dot represented as the circle ○ including a number, 1, is formed by the nozzle N1.

A range indicated by arrows denoted by the reference numeral, "first pass", represents positions which are scanned by the recording head 1 in the secondary scanning direction when an image is recorded in the first pass. Similarly, a range indicated by arrows denoted by the reference numeral, "fifth pass", represents positions which are scanned by the recording head 1 in the secondary scanning direction when an image is recorded in the fifth pass.

In the drawing (FIG. 9), painted dots are dots to which ink is correctly put. On the other hand, unpainted dots (dots D1 to D3, and dots D41 to D43) are dots which are not correctly formed due to a malfunctioning nozzle although the dots are to be actually formed. The other dots are dots onto which ink is not discharged because image information for the other dots represents OFF. If the image information represents ON for the other dots, the other dots are to be recorded by the nozzles N1 to N12 of the recording head 1 when images are recorded in the second to the fourth passes, and the sixth to the eighth passes.

The test pattern P2 as shown in FIG. 9 enables a nozzle causing the image fault to be easily identified. That is, in this test pattern, when a cycle of a series of interlace-scanning is stared (for example, when each of the first pass and the fifth pass starts), the nozzles (the nozzles N1 and N12) positioned at the end portions of the recording head 1 in the secondary scanning direction are each controlled so as to record a scan line which is longer than scan lines of the other nozzles (the nozzles N2 to N11) in the primary scanning direction. Therefore, it is easy to identify a reference position used for measuring a position at which the image fault occurs in the test pattern P2.

Firstly, an operator identifies the reference position by using dots D21 to D26 and dots D31 to D36 on the test pattern P2.

Next, the test pattern P2 is searched for a portion in which the image fault occurs. Since no dot is formed, in the primary scanning direction, in an area in which the malfunctioning nozzle (N2 in this exemplary case) forms an image, by a nozzle other than the malfunctioning nozzle, the dots D1, D2, and D3 and the dots D41, D42, and D43 at each of which the image fault occurs can be easily identified.

Even when the image fault represents ink fading (reduction in ink concentration), the dot at which the image fault occurs can be easily identified. Further, if the ink concentration is zero, the dot at which the image fault occurs can be easily identified based on a blank portion in the test image P2.

Next, a distance from the dot D21 to the dot D1 in the secondary scanning direction is measured. Based on the measured distance, it can be easily determined that the nozzle N2 in the first pass malfunctions. Similarly, a distance from the dot D51 to the dot D41 in the secondary scanning direction is measured. Based on the measured distance, it can be easily determined that the nozzle N2 in the fifth pass malfunctions.

As described above, according to the present embodiment, a malfunctioning nozzle and a pass number in which the nozzle malfunctions can be easily identified. Therefore, even when a plurality of image faults appear on the test pattern P2, it can be also determined whether the image faults are caused by repeated malfunctioning of the same one nozzle, or by malfunctionings of various nozzles.

Figure 10:
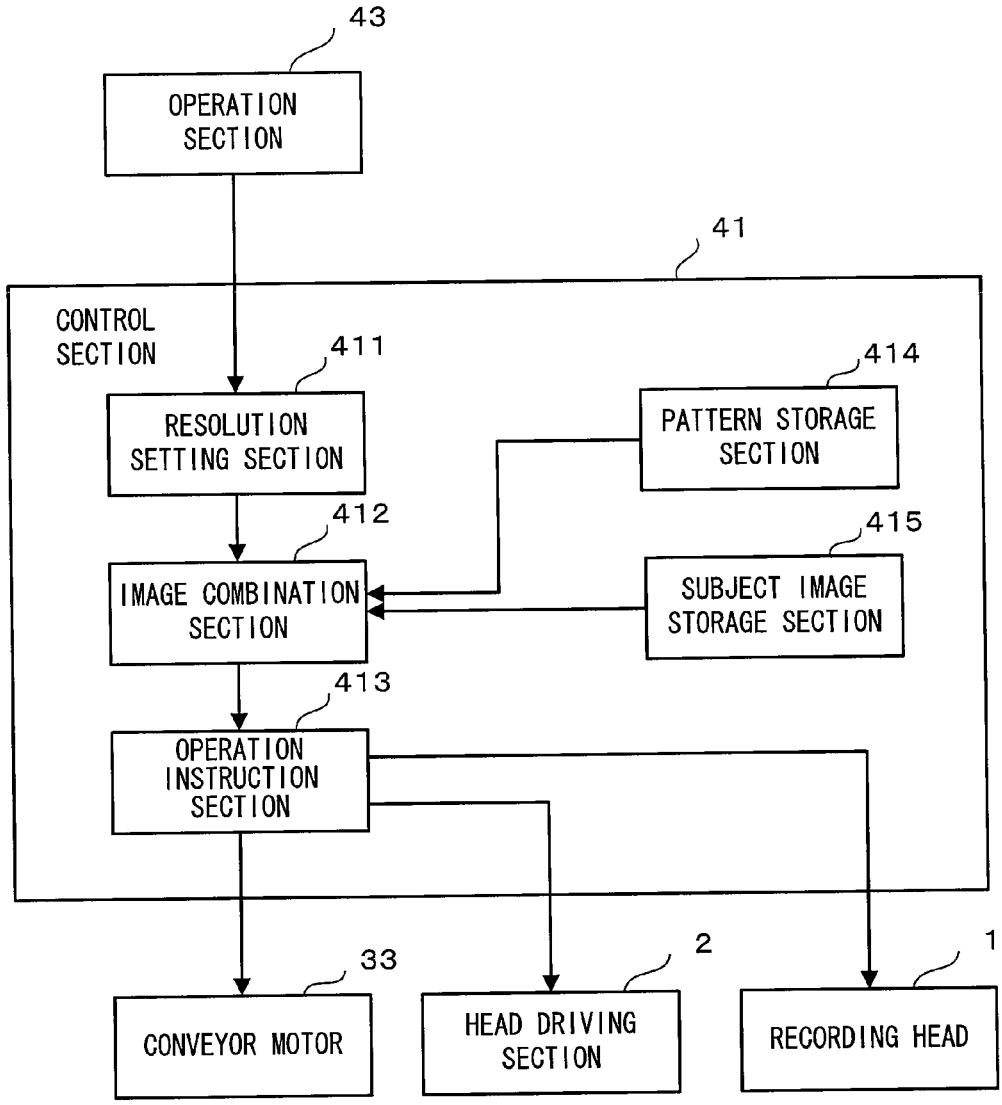
FIG. 10 is a functional block diagram illustrating an exemplary main portion of the ink-jet recording apparatus according to the present invention.

FIG. 10 is a functional block diagram illustrating an exemplary main portion of the ink-jet recording apparatus 100 according to the present invention. The control section 41 functionally includes a resolution setting section 411, an image combination section 412, an operation instruction section 413, a pattern storage section 414, and a subject image storage section 415. The control section 41 causes the CPU to execute a control program previously stored in the ROM or the like, so that the CPU functions as a functional section such as the resolution setting section 411, the image combination section 412, the operation instruction section 413, and a memory such as the RAM functions as a functional section such as the pattern storage section 414 and the subject image storage section 415.

The pattern storage section 414 (corresponding to second pattern storage portion) is a functional section for previously storing second pattern information. The second pattern information represents image information of the first resolution (the resolution for the primary scanning direction=600 dpi, and the resolution for the secondary scanning direction=300 dpi) corresponding to the test pattern P2 of the second resolution. The image information represented by the second pattern information is generated based on image information of the second resolution corresponding to the test pattern P2 of the second resolution (the resolution for the primary scanning direction=300 dpi, and the resolution for the secondary scanning direction=150 dpi).

Further, a plurality of pieces of image information are previously generated so as to be associated with a plurality (four in the present embodiment) of resolutions, respectively, which can be set as the first resolution which is a resolution of the subject image. The plurality of pieces of image information described above are each generated based on first pattern information (see FIG. 6C) representing image information of the second resolution corresponding to the test pattern P2 of the second resolution (the resolution for the primary scanning direction=300 dpi, and the resolution for the secondary scanning direction =150 dpi). The pattern storage section 414 is a functional section for previously storing the plurality of pieces of image information having been generated so as to be associated with the plurality (four in the present embodiment) of resolutions, respectively. Details will be described below with reference to FIG. 12A.

Figure 11A:
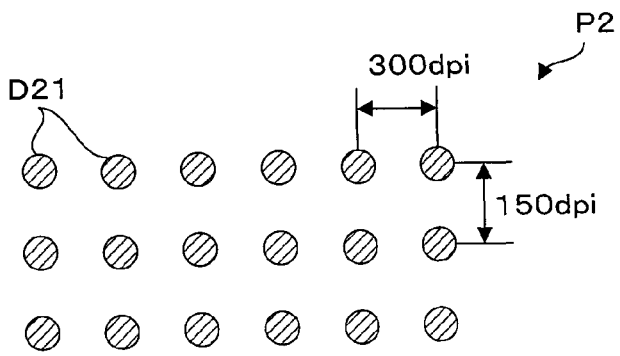
FIG. 11A is a diagram illustrating an exemplary resolution of the test pattern (rectangular pattern)

An exemplary method for generating the second pattern information stored in the pattern storage section 414 will be described with reference to FIG. 11A, FIG. 11B, FIG. 11C, FIG. 12A, FIG. 12B, and FIG. 12C. FIG. 11A (which is the same as FIG. 6C) is a diagram illustrating an exemplary resolution of the test pattern P2 (the rectangular pattern P21). That is, in this example, the second resolution which is a resolution of the test pattern P2 is set such that the resolution for the primary scanning direction is 300 dpi, and the resolution for the secondary scanning direction is 150 dpi. The image information of the test pattern P2 of the second resolution is formed by pixel information D21.

Figure 11B:
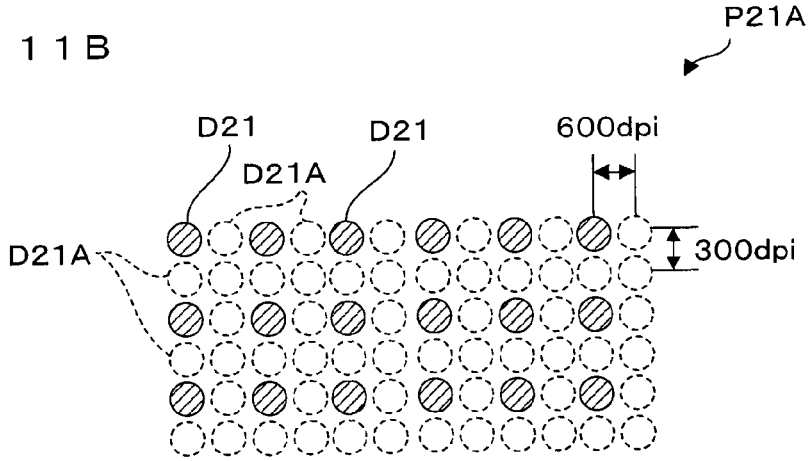
FIG. 11B is a diagram illustrating exemplary image information (=second pattern information) of a first resolution corresponding to the test pattern (rectangular pattern) in a case where the first resolution is set such that a resolution for a primary scanning direction is 600 dpi, and a resolution for a secondary scanning direction is 300 dpi.

FIG. 11B is a diagram illustrating exemplary image information P21A (=the second pattern information) which is represented by using the first resolution and corresponds to the test pattern P2 (the rectangular pattern P21), in which the first resolution is set such that the resolution for the primary scanning direction is 600 dpi, and the resolution for the secondary scanning direction is 300 dpi. As shown in FIG. 11B, the image information P21A (=the second pattern information) which is represented by using the first resolution and corresponds to the test pattern P2 (the rectangular pattern P21) is generated by adding, to the test pattern P2 of the second resolution shown in FIG. 11A, image information D21A representing pixels each of which is indicated as a dashed-line circle shown in FIG. 11B and represents no dot (=no ink is discharged into the pixels), and an amount of the image information D21A to be added corresponds to the number of pixels obtained by subtracting the number of pixels corresponding to the second resolution from the number of pixels corresponding to the first resolution. Specifically, the image information D21A corresponding to one pixel is firstly inserted between pixel information D21 which is shown in FIG. 11A, and represents any two adjacent pixels aligned in the secondary scanning direction. Subsequently, the image information D21A corresponding to one pixel is inserted between the pixel information D21 (and the image information D21A) representing any two adjacent pixels aligned in the primary scanning direction.

Figure 11C:
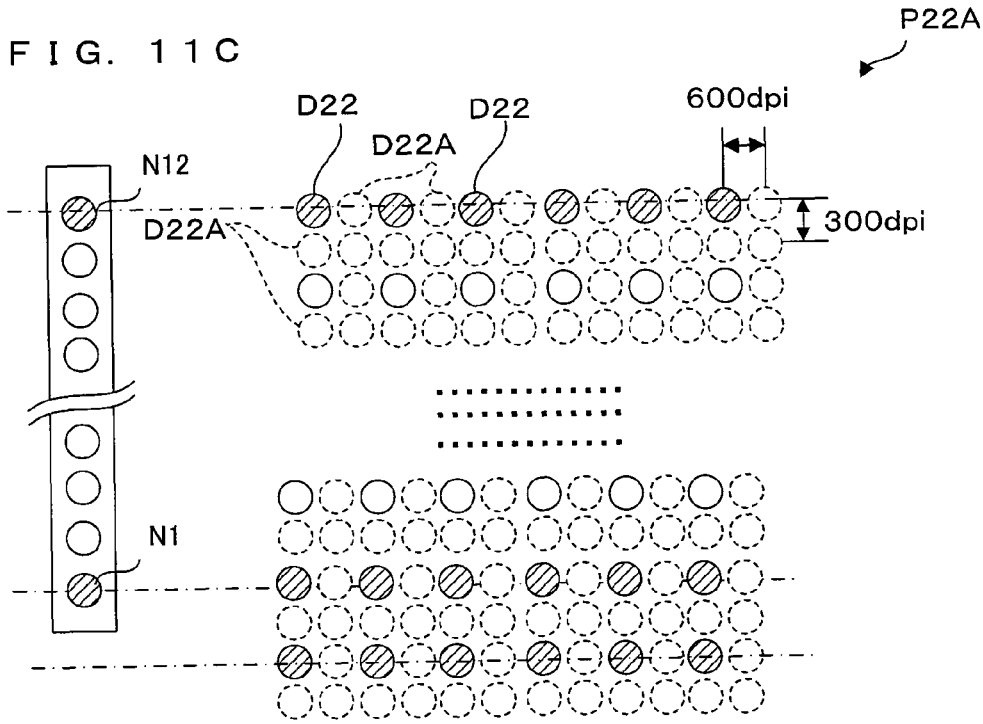
FIG. 11C is a diagram illustrating exemplary image information (=second pattern information) of a first resolution corresponding to the test pattern (projection pattern) in a case where the first resolution is set such that a resolution for the primary scanning direction is 600 dpi, and a resolution for the secondary scanning direction is 300 dpi.

FIG. 11C is a diagram illustrating exemplary image information P22A (=the second pattern information) which is represented by using the first resolution and corresponds to the test pattern P2 (the projection pattern P22), in which the first resolution is set such that the resolution for the primary scanning direction is 600 dpi, and the resolution for the secondary scanning direction is 300 dpi. As shown in FIG. 11C, the image information P22A (=the second pattern information) which is represented by using the first resolution and corresponds to the test pattern P2 (the projection pattern P22) is generated by adding, to the test pattern P2 (the projection pattern P22) of the second resolution, image information D22A representing pixels each of which is indicated as a dashed-line circle shown in FIG. 11C and represents no dot (=no ink is discharged into the pixels), and an amount of the image information D22A to be added corresponds to the number of pixels obtained by subtracting the number of pixels corresponding to the second resolution from the number of pixels corresponding to the first resolution. Specifically, the image information D22A corresponding to one pixel is firstly inserted between pixel information D22 which is shown in FIG. 11C, and represents any two adjacent pixels aligned in the secondary scanning direction. Subsequently, the image information D22A corresponding to one pixel is inserted between the pixel information D22 (and the image information D22A) representing any two adjacent pixels aligned in the primary scanning direction. The pixel information D22 which is represented, as shown in FIG. 11C, as a solid line circle ○ including no diagonal line represents a pixel, in the test pattern P2 (the projection pattern P22) of the second resolution, which does not form a dot (that is, into which no ink is discharged)

FIGS. 12A, 12B, and 12C are diagrams illustrating exemplary second pattern information stored in the pattern storage section 414. FIG. 12A shows a table representing an exemplary content of the second pattern information stored in the pattern storage section 414. The table shown in FIG. 12A indicates resolutions for the primary scanning direction which can be set as the first resolution, resolutions for the secondary scanning direction which can be set as the first resolution, the reference numerals representing image data of the test pattern, and FIG. Nos. in order, respectively, starting from the left side of the table. The pattern storage section 414 stores resolution information of the table as shown in FIG. 12A, and image information which are denoted by the reference numerals shown in the drawings corresponding to the FIG. Nos. For example, as the image information of the test pattern in which the resolution for the primary scanning direction is 600 dpi, and the resolution for the secondary scanning direction is 300 dpi, the image information P21A and P22A shown in FIGS. 11B and 11C, respectively, are stored.

FIG. 12B is a diagram illustrating exemplary image information P21B (=the second pattern information) which is represented by using the first resolution and corresponds to the test pattern P2 (the rectangular pattern P21), in which the first resolution is set such that the resolution for the primary scanning direction is 300 dpi, and the resolution for the secondary scanning direction is 300 dpi. In this case, the image information P21B (=the second pattern information) which is represented by using the first resolution and corresponds to the test pattern P2 (the rectangular pattern P21) is generated by adding, to the test pattern P2 of the second resolution shown in FIG. 11A, image information D21B representing pixels each of which is indicated as a dashed-line circle shown in FIG. 12B and represents no dot (=no ink is discharged into the pixels), and an amount of the image information D21B to be added corresponds to the number of pixels obtained by subtracting the number of pixels corresponding to the second resolution from the number of pixels corresponding to the first resolution. Specifically, the image information D21B corresponding to one pixel is inserted between pixel information D21 which is shown in FIG. 11A, and represents any two adjacent pixels aligned in the secondary scanning direction.

FIG. 12C is a diagram illustrating exemplary image information P21C (=the second pattern information) which is represented by using the first resolution and corresponds to the test pattern P2 (the rectangular pattern P21), in which the first resolution is set such that the resolution for the primary scanning direction is 600 dpi, and the resolution for the secondary scanning direction is 150 dpi. In this case, the image information P21C (=the second pattern information) which is represented by using the first resolution and corresponds to the test pattern P2 (the rectangular pattern P21) is generated by adding, to the test pattern P2 of the second resolution shown in FIG. 11A, image information D21C representing pixels each of which is indicated as a dashed-line circle shown in FIG. 12C and represents no dot (=no ink is discharged into the pixels), and an amount of the image information D21C to be added corresponds to the number of pixels obtained by subtracting the number of pixels corresponding to the second resolution from the number of pixels corresponding to the first resolution. Specifically, the image information D21C corresponding to one pixel is inserted between pixel information D21 which is shown in FIG. 11A, and represents any two adjacent pixels aligned in the primary scanning direction.

As described above, the image information D21A (or D21B, or D21C), or D22A each corresponding to a pixel which does not form an image of the test pattern P2 and represents no dot is added by an amount corresponding to a difference (=(the first resolution) −(the second resolution)) in resolution, thereby generating image information (=the second pattern information) which temporarily has the number of pixels corresponding to the first resolution, and which can represent the test pattern P2 of the second resolution. Thus, it is possible to appropriately form the test pattern P2 by using a simplified configuration.

Returning to FIG. 10, a functional configuration of the control section 41 will be described. The subject image storage section 415 is a functional section for previously storing image information of the subject image P1 having the first resolution (for example, the resolution for the primary scanning direction is 600 dpi, and the resolution for the secondary scanning direction is 300 dpi).

The resolution setting section 411 (corresponding to a part of the resolution setting portion) is a functional section for receiving an operation input from a user through the operation section 43, and setting, as the first resolution, one of a plurality (four in the present embodiment) of predetermined resolutions (see FIG. 12A), based on the received operation input.

The image combination section 412 (corresponding to image combination portion) is a functional section for combining image information corresponding to the subject image P1 of the first resolution set by the resolution setting section 411, with the second pattern information (see FIGS. 11B and 11C) which corresponds to the test pattern P2 of the second resolution (in the present embodiment, the resolution for the primary scanning direction=300 dpi, and the resolution for the secondary scanning direction=150 dpi), and which represents the image information of the first resolution (for example, the resolution for the primary scanning direction=600 dpi, and the resolution for the secondary scanning direction=300 dpi) set by the resolution setting section 411, so as to generate combined image information as one piece of image information.

In other words, the image combination section 412 is a functional section for combining image information corresponding to the subject image P1 of the first resolution set by the resolution settings section 411, with image information (=the second pattern information) of the test pattern P2, which is image information obtained by converting image information of the second resolution into image information of the first resolution set by the resolution setting section 411, thereby generating the combined image information as one piece of image information.

The operation instruction section 413 (corresponding to first instruction portion and second instruction portion) is a functional section for instructing the recording head 1, the head driving section 2, and the medium driving section 3 to form the subject image P1 of the first resolution set by the resolution setting section 411. Further, the operation instruction section 413 is also a functional section for instructing the recording head 1, the head driving section 2, and the medium driving section 3 to form, in an area other than an area in which the subject image P1 on the recording medium PA is formed, the test pattern P2 of the predetermined second resolution different from the first resolution.

Specifically, the operation instruction section 413 instructs the recording head 1, the head driving section 2, and the medium driving section 3 to form, on the recording medium PA, image information generated as one piece of image information through the combination performed by the image combination section 412. The image information which is generated as one piece of image information through the combination performed by the image combination section 412 is image information of the first resolution set by the resolution setting section 411, and therefore, when the first resolution is based on the interlace mode, the operation instruction section 413 causes the recording head 1, the head driving section 2, and the medium driving section 3 to operate in the interlace mode.

Figure 13:
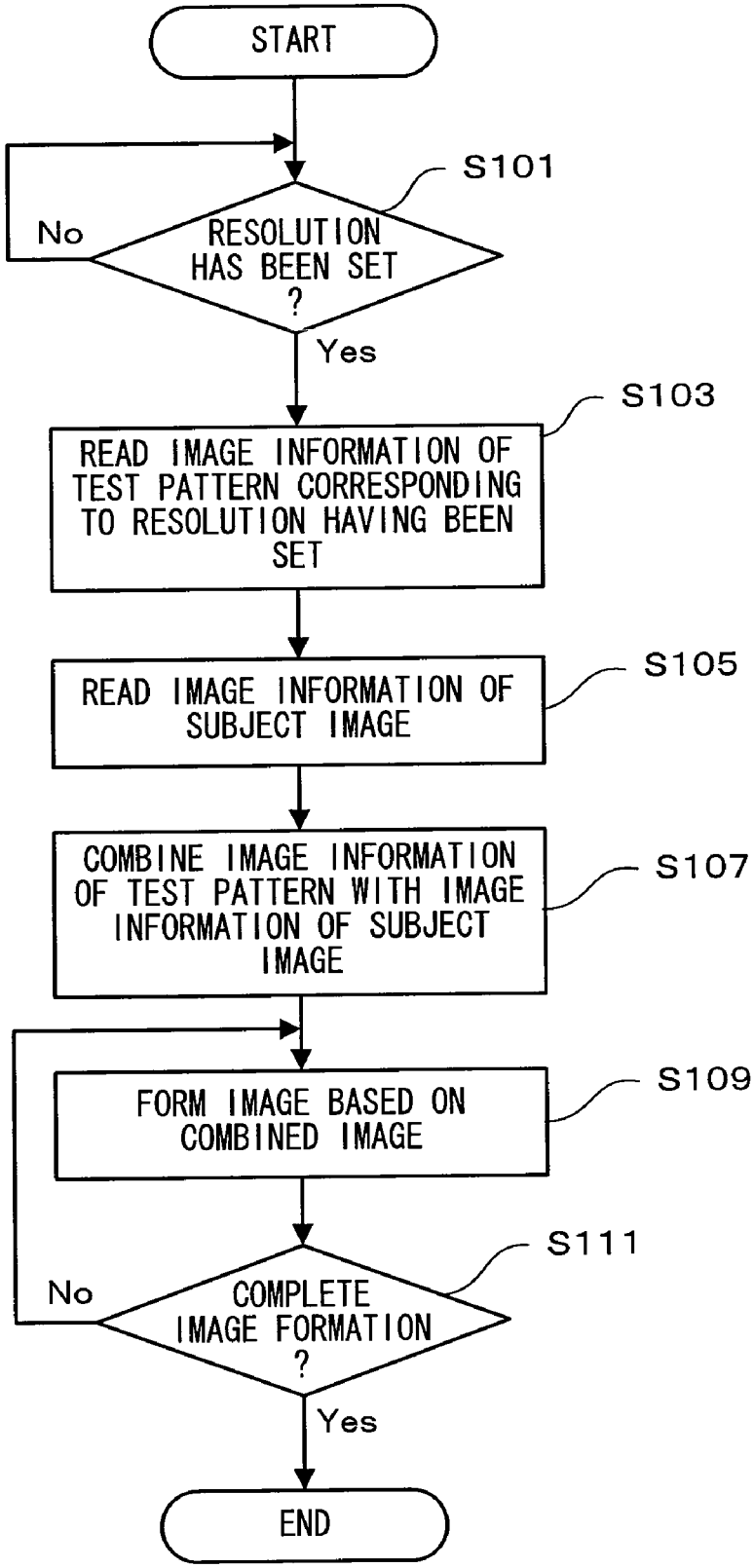
FIG. 13 is a flow chart showing an exemplary operation performed by a control section shown in FIG. 10.

FIG. 13 is a flow chart showing an exemplary operation performed by the control section 41 shown in FIG. 10. Firstly, the resolution setting section 411 determines whether or not the first resolution has been set through the operation section 43 (S101). When it is determined that the first resolution is not set (No in S101), the process is in a waiting state. When it is determined that the first resolution has been set (Yes in S101), the image combination section 412 reads, from the pattern storage section 414, the image information (=the second pattern information) of the test pattern P2 represented by using the first resolution having been set in step S101 (S103). The image combination section 412 reads the image information of the subject image P1 from the subject image storage section 415 (S105).

Next, the image combination section 412 combines the image information of the test pattern P2, which is represented by using the first resolution and has been read in step S103, with the image information of the subject image P1 having been read in step S105, so as to generate the combined image information as one piece of image information (S107). The operation instruction section 413 operates so as to form, on the recording medium PA, an image corresponding to the image information generated in step S107 (S109). The operation instruction section 413 determines whether or not formation of the image has been completed (S111). When it is determined that the formation of the image has been completed (Yes in S111), the process is ended. When it is determined that the formation of the image has not been completed (No in S111), the process is returned to step S109, and the step S109 and the subsequent steps are repeated.

As described above, the pattern storage section 414 previously stores the second pattern information which is generated based on the first pattern information. The second pattern information represents image information of the first resolution corresponding to the test pattern P2 of the second resolution, and the first pattern information represents image information of the second resolution corresponding to the test pattern P2 of the second resolution. Further, the second pattern information stored in the second pattern storage section 414 is read, and the test pattern P2 of the second resolution is formed based on the second pattern information having been read. Thus, a process of generating the second pattern information is unnecessary, thereby efficiently forming an appropriate test pattern.

In the present embodiment, the pattern storage section 414 previously stores the second pattern information which represents image information of the first resolution corresponding to the test pattern P2 of the second resolution, and which is generated based on the first pattern information which represents the image information of the second resolution corresponding to the test pattern P2 of the second resolution. However, a process of generating the second pattern information which represents image information of the first resolution corresponding to the test pattern P2 of the second resolution, based on the first pattern information which represents the image information of the second resolution corresponding to the test pattern P2 of the second resolution, may be performed.

Further, the pattern storage section 414 previously stores a plurality of pieces of image information each corresponding to the test pattern of the second resolution, so as to be associated with a plurality (four in the present embodiment) of predetermined resolutions, respectively. Further, an operation input is received from a user through the operation section 43, and one of the plurality (four in the present embodiment) of resolutions is set as the first resolution based on the received operation input. Furthermore, the image information represented by using the resolution set as the first resolution is read from the pattern storage section 414, and the test pattern P2 of the second resolution is formed based on the image information having been read. The image information of the resolution which is the same as the resolution set as the resolution (the first resolution) of the subject image P1 is read as the image information of the test pattern P2, thereby forming the test pattern P2. Therefore, the test pattern P2 can be appropriately formed with enhanced efficiency.

Further, the pattern storage section 414 previously stores second pattern information which represents image information of the first resolution corresponding to the test pattern P2 of the second resolution, and which is generated based on the first pattern information which represents image information of the second resolution corresponding to the test pattern P2 of the second resolution. Further, the image information corresponding to the subject image P1 of the first resolution is combined with the second pattern information, so as to generate the combined image information as one piece of image information. Further, the subject image P1 of the first resolution and the test pattern P2 of the second resolution are formed based on the generated image information. Therefore, it is possible to form an appropriate test pattern with enhanced efficiency.

That is, both the subject image P1 and the test pattern P2, which have resolutions different from each other, are represented as the image information of the first resolution, and further the two pieces of the image information of the first resolution are combined with each other so as to generate the combined image information as one piece of image information. Further, the subject image P1 and the test pattern P2 are formed based on the generated image information. An operation (for example, an operation based on the interlace mode) performed by an apparatus for forming the subject image P1 and the test pattern P2 can be the same as an operation (for example, an operation based on the interlace mode) for forming an image corresponding to one piece of image information of the first resolution. Therefore, it is possible to form an appropriate test pattern with enhanced efficiency.

In the present embodiment, the image combination section 412 combines the image information corresponding to the subject image P1 of the first resolution, with the second pattern information. However, a combined image obtained by combining the image information corresponding to the subject image P1 of the first resolution, with the second pattern information, may be previously stored. In this case, the combination process can be eliminated, and therefore an appropriate test pattern can be formed with enhanced efficiency.

The ink-jet recording apparatus according to the present invention is not limited to the ink-jet recording apparatus 100 according to the present embodiment, and the following configuration may be used.

(A) In the present embodiment, the control section 41 functionally includes the resolution setting section 411, the image combination section 412, the operation instruction section 413, the pattern storage section 414, the subject image storage section 415, and the like. However, at least one of the functional sections corresponding to the resolution setting section 411, the image combination section 412, the operation instruction section 413, the pattern storage section 414, and the subject image storage section 415 may be configured as hardware such as an electrical circuit.

(B) In the present embodiment, a resolution, for the primary scanning direction, included in the second resolution is lower than a resolution, for the primary scanning direction, included in the first resolution, or a resolution, for the secondary scanning direction, included in the second resolution is lower than a resolution, for the secondary scanning direction, included in the first resolution, or a resolution, for the primary scanning direction, included in the second resolution and a resolution, for the secondary scanning direction, included in the second resolution are lower than a resolution, for the primary scanning direction, included in the first resolution, and a resolution, for the secondary scanning direction, included in the first resolution, respectively. However, a resolution, for the primary scanning direction, included in the second resolution is higher than a resolution, for the primary scanning direction, included in the first resolution, or a resolution, for the secondary scanning direction, included in the second resolution is higher than a resolution, for the secondary scanning direction, included in the first resolution, or a resolution, for the primary scanning direction, included in the second resolution and a resolution, for the secondary scanning direction, included in the second resolution are higher than a resolution, for the primary scanning direction, included in the first resolution, and a resolution, for the secondary scanning direction, included in the first resolution, respectively. In this case, even when the first resolution corresponding to a resolution of the subject image P1 is set low, the test pattern P2 of a predetermined resolution can be used. Specifically, a resolution which enables the most appropriate visual checking is previously selected as the resolution of the test pattern P2, and the test pattern P2 of the selected resolution is formed regardless of whether the resolution (=the first resolution) of the subject image is high or low, thereby forming the test pattern P2 having improved usability.

(C) In the present embodiment, the first resolution is a resolution which enables an image to be formed in the interlace mode, and does not enable an image to be formed in a non-interlace mode which is different from the interlace mode, and the second resolution is a resolution which enables an image to be formed in the non-interlace mode. However, the first resolution and the second resolution may be each a resolution which enables an image to be formed in the interlace mode, and does not enable an image to be formed in the non-interlace mode. Alternatively, the first resolution and the second resolution may be each a resolution which enables an image to be formed in the non-interlace mode.

(D) In the present embodiment, the image information of the subject image is previously stored in the subject image storage section 415. However, the image information of the subject image may be loaded from another device, another storage medium, or the like. For example, the image information of the subject image may be loaded from a terminal apparatus, such as a personal computer, which is connected to the controller 4 (the control section 41) through a communication line such as the Internet and a LAN (Local Area Network) so as to allow communication therebetween.

(E) In the present embodiment, by using the control section 41, the test pattern P2 is converted to the image information of the first resolution, and the converted test pattern P2 is combined with the image information of the subject image P1 so as to generate combined image information, and the subject image P1 and the test pattern P2 are formed based on the combined image information. However, the subject image P1 and the test pattern may be formed in another method.

Figure 14:
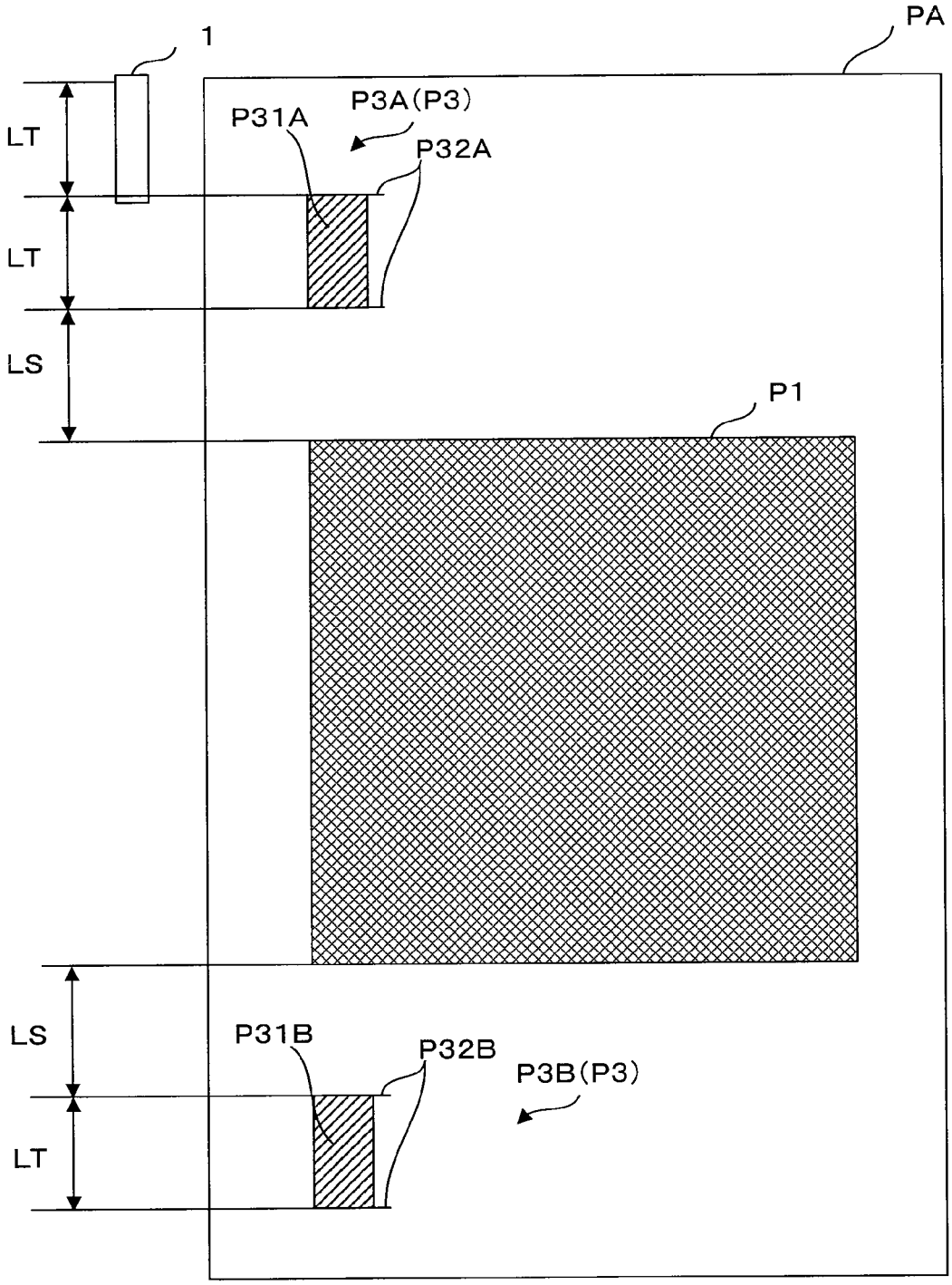
FIG. 14 is a diagram illustrating another exemplary method for forming the subject image and the test pattern.

FIG. 14 is a diagram illustrating another exemplary method for forming the subject image P1 and the test pattern. Specifically, as shown in FIG. 14, the test pattern P3 (P3A, P3B) may be formed, based on the image information of the second resolution, at a position distanced from the subject image P1 by a distance LS greater than the distance LT (refer to FIG. 2A) in the secondary scanning direction. In this case, it is unnecessary to perform a process for converting the image information of the test pattern P3 so as to represent the image information of the first resolution, and a process for combining two pieces of image information, so that an appropriate test pattern can be formed by using an increasingly simplified configuration.

Further, also when the first resolution corresponding to a resolution of the subject image P1 is high and enables an operation based on the interlace mode to be realized, switching between the operation based on the interlace mode and an operation based on the non-interlace mode may be performed when the recording head 1 (the nozzles N1 to N12) scans a position, in the secondary scanning direction, within a distance LS between the subject image P1 and the test pattern P3, so that an appropriate test pattern can be formed by using a simplified configuration.

While the invention has been described in detail, the foregoing description is in all aspects illustrative and not restrictive. It is understood that numerous other modifications and variations can be devised without departing from the scope of the invention.

What is claimed is:

1. An image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion so as to form, on the recording medium, a subject image which is a predetermined image;

a first instruction portion for instructing the recording head, the primary scanning portion, and the secondary scanning portion to form the subject image of a first resolution which is previously set;

a second instruction portion for instructing the recording head, the primary scanning portion, and the secondary scanning portion to form, in an area other than an area in which the subject image on the recording medium is formed, a test pattern of a second resolution which is previously set and is different from the first resolution;

a first pattern storage portion for previously storing therein first pattern information representing image information of the second resolution corresponding to the test pattern of the second resolution; and a pattern generation portion for reading the first pattern information from the first pattern storage portion and generating, based on the first pattern information read, second pattern information representing image information of the first resolution corresponding to the test pattern of the second resolution, wherein the second instruction portion operates so as to form the test pattern of the second resolution based on the second pattern information generated by the pattern generation portion.

2. The image forming apparatus according to claim 1, wherein a resolution, for the primary scanning direction, included in the second resolution is lower than a resolution, for the primary scanning direction, included in the first resolution, or a resolution, for the secondary scanning direction, included in the second resolution is lower than a resolution, for the secondary scanning direction, included in the first resolution, or a resolution, for the primary scanning direction, included in the second resolution and a resolution, for the secondary scanning direction, included in the second resolution are lower than a resolution, for the primary scanning direction, included in the first resolution, and a resolution, for the secondary scanning direction, included in the first resolution, respectively.

3. The image forming apparatus according to claim 2, wherein:

the first resolution enables an image to be formed in an interlace mode, and the second resolution enables an image to be formed in a non-interlace mode other than the interlace mode.

4. The image forming apparatus according to claim 1, wherein;

when the first resolution is higher than the second resolution, the pattern generation portion adds to the first pattern information image information representing a pixel at which a dot is not formed, and an amount of the image information to be added corresponds to the number of pixels obtained by subtracting the number of pixels corresponding to the second resolution from the number of pixels corresponding to the first resolution, so that the second pattern information is generated.

5. The image forming apparatus according to claim 1, wherein the test pattern includes a test pattern generated by a specific dot forming section which is previously set and is at least one of the plurality of dot forming sections aligned in the recording head in the secondary scanning direction.

6. The image forming apparatus according to claim 5, wherein the specific dot forming section is at least one of dot forming sections positioned on both ends of the recording head, among the plurality of dot forming sections aligned in the recording head in the secondary scanning direction.

7. The image forming apparatus according to claim 5, wherein the test pattern is an almost rectangular pattern having sides extending in the primary scanning direction and sides extending in the secondary scanning direction, and the test pattern generated by the specific dot forming section projects from one of the sides extending in the secondary scanning direction, the one of the sides corresponding to a part of a rectangle forming an outer edge of the test pattern.

8. The image forming apparatus according to claim 1, wherein the second instruction portion forms the test pattern at a position distanced by a predetermined distance in the primary scanning direction from the area in which the subject image on the recording medium is formed.

9. An image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion so as to form, on the recording medium, a subject image which is a predetermined image;

a first instruction portion for instructing the recording head, the primary scanning portion, and the secondary scanning portion to form the subject image of a first resolution which is previously set;

a second instruction portion for instructing the recording head, the primary scanning portion, and the secondary scanning portion to form, in an area other than an area in which the subject image on the recording medium is formed, a test pattern of a second resolution which is previously set and is different from the first resolution; and a second pattern storage portion for previously storing second pattern information representing image information of the first resolution corresponding to the test pattern of the second resolution, the second pattern information generated based on first pattern information representing image information of the second resolution corresponding to the test pattern of the second resolution, wherein the second instruction portion reads the stored second pattern information from the second pattern storage portion, and forms the test pattern of the second resolution based on the second pattern information read.

10. The image forming apparatus according to claim 9, comprising a resolution setting portion for receiving an operation input from outside, and setting, as the first resolution, one of a plurality of resolutions which are previously set, based on the received operation input, wherein:

the second pattern storage portion previously stores a plurality of pieces of image information so as to be associated with the plurality of resolutions, respectively, the plurality of pieces of image information each corresponding to the test pattern of the second resolution and being generated based on the first pattern information; and the second instruction portion reads, from the second pattern storage portion, one of the plurality of pieces of image information associated with the one of the plurality of resolutions set as the first resolution, and forms the test pattern of the second resolution based on the one of the plurality of pieces of image information read.

11. An image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion to form, on the recording medium, a subject image which is a predetermined image;

a first instruction portion for instructing the recording head, the primary scanning portion, and the secondary scanning portion to form the subject image of a first resolution which is previously set;

a second instruction portion for instructing the recording head, the primary scanning portion, and the secondary scanning portion to form, in an area other than an area in which the subject image on the recording medium is formed, a test pattern of a second resolution which is previously set and is different from the first resolution;

a second pattern storage portion for previously storing second pattern information representing image information of the first resolution corresponding to the test pattern of the second resolution, the second pattern information that is generated based on first pattern information representing image information of the second resolution corresponding to the test pattern of the second resolution; and an image combination portion for combining the second pattern information with image information corresponding to the subject image of the first resolution to generate combined image information as one piece of image information, wherein the first instruction portion and the second instruction portion form the subject image of the first resolution and the test pattern of the second resolution, respectively, based on the combined image information generated by the image combination portion.

12. An image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion to form, on the recording medium, a subject image which is a predetermined image, a first instruction portion for instructing the recording head, the primary scanning portion, and the secondary scanning portion to form the subject image of a first resolution which is previously set;

a second instruction portion for instructing the recording head, the primary scanning portion, and the secondary scanning portion to form, in an area other than an area in which the subject image on the recording medium is formed, a test pattern of a second resolution which is previously set and is different from the first resolution; and a combined image storage portion for previously storing combined image information corresponding to one piece of image information generated by combining second pattern information with image information corresponding to the subject image of the first resolution, the second pattern information representing image information of the first resolution corresponding to the test pattern of the second resolution, the second pattern information being generated based on first pattern information representing image information of the second resolution corresponding to the test pattern of the second resolution, wherein the first instruction portion and the second instruction portion read the combined image information stored in the combined image storage portion, and form, based on the combined image information read, the subject image of the first resolution and the test pattern of the second resolution, respectively.

13. An image forming method performed by an image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion to form, on the recording medium, a subject image which is a predetermined image, the image forming method comprising:

a first instruction step of instructing the recording head, the primary scanning portion, and the secondary scanning portion to form the subject image of a first resolution which is previously set;

a second instruction step of instructing the recording head, the primary scanning portion, and the secondary scanning portion to form, in an area other than an area in which the subject image on the recording medium is formed, a test pattern of a second resolution which is previously set and is different from the first resolution;

a first pattern storage step of previously storing, in a first pattern storage portion, first pattern information representing image information of the second resolution corresponding to the test pattern of the second resolution, and a pattern generation step of reading the first pattern information from the first pattern storage portion, and generating, based on the first pattern information read, second pattern information representing image information of the first resolution corresponding to the test pattern of the second resolution, wherein the second instruction step operates to form the test pattern of the second resolution based on the second pattern information generated by the pattern generation step.

14. An image forming method performed by an image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion to form, on the recording medium, a subject image which is a predetermined image, the image forming method comprising:

a first instruction step of instructing the recording head, the primary scanning portion, and the secondary scanning portion to form the subject image of a first resolution which is previously set;

a second instruction step of instructing the recording head, the primary scanning portion, and the secondary scanning portion to form, in an area other than an area in which the subject image on the recording medium is formed, a test pattern of a second resolution which is previously set and is different from the first resolution; and a second pattern storage step of previously storing, in a second pattern storage portion, second pattern information representing image information of the first resolution corresponding to the test pattern of the second resolution, the second pattern information generated based on first pattern information representing image information of the second resolution corresponding to the test pattern of the second resolution, wherein the second instruction step reads the second pattern information stored in the second pattern storage portion and forms the test pattern of the second resolution based on the second pattern information read.

15. An image forming method performed by an image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion to form, on the recording medium, a subject image which is a predetermined image, the image forming method comprising:

a first instruction step of instructing the recording head, the primary scanning portion, and the secondary scanning portion to form the subject image of a first resolution which is previously set;

a second instruction step of instructing the recording head, the primary scanning portion, and the secondary scanning portion to form, in an area other than an area in which the subject image on the recording medium is formed, a test pattern of a second resolution which is previously set and is different from the first resolution;

a second pattern storage step of previously storing, in a second pattern storage portion, second pattern information representing image information of the first resolution corresponding to the test pattern of the second resolution, the second pattern information generated based on first pattern information representing image information of the second resolution corresponding to the test pattern of the second resolution, and an image combination step of combining the second pattern information with image information corresponding to the subject image of the first resolution to generate combined image information as one piece of the image information, wherein the first instruction step and the second instruction step form the subject image of the first resolution and the test pattern of the second resolution, respectively, based on the combined image information generated by the image combination step.

16. An image forming method performed by an image forming apparatus comprising:

a recording head having aligned in a secondary scanning direction a plurality of dot forming sections each of which is a component for forming a dot on a recording medium;

a primary scanning portion for moving the recording head relative to the recording medium in a primary scanning direction intersecting the secondary scanning direction; and a secondary scanning portion for moving the recording head relative to the recording medium in the secondary scanning direction, wherein the recording head is moved relative to the recording medium by means of the primary scanning portion and the secondary scanning portion to form, on the recording medium, a subject image which is a predetermined image, the image forming method comprising:

a first instruction step of instructing the recording head, the primary scanning portion, and the secondary scanning portion to form the subject image of a first resolution which is previously set;

a second instruction step of instructing the recording head, the primary scanning portion, and the secondary scanning portion to form, in an area other than an area in which the subject image on the recording medium is formed, a test pattern of a second resolution which is previously set and is different from the first resolution; and a combined image storage step of previously storing, in a combined image storage portion, combined image information corresponding to one piece of image information generated by combining second pattern information with the image information corresponding to the subject image of the first resolution, the second pattern information representing image information of the first resolution corresponding to the test pattern of the second resolution, the second pattern information generated based on first pattern information representing image information of the second resolution corresponding to the test pattern of the second resolution, wherein the first instruction step and the second instruction step read the combined image information stored in the combined image storage portion, and form, based on the combined image information read, the subject image of the first resolution and the test pattern of the second resolution, respectively.

* * * * *